US012571565B2

(12) United States Patent
Martin

(10) Patent No.: US 12,571,565 B2
(45) Date of Patent: Mar. 10, 2026

(54) $CO_2$ REFRIGERATION SYSTEM WITH EXTERNAL COOLANT CONTROL

(71) Applicant: Hill Phoenix, Inc., Conyers, GA (US)

(72) Inventor: J. Scott Martin, Conyers, GA (US)

(73) Assignee: Hill Phoenix, Inc., Conyers, GA (US)

( * ) Notice: Subject to any disclaimer, the term of this patent is extended or adjusted under 35 U.S.C. 154(b) by 146 days.

(21) Appl. No.: 18/249,141

(22) PCT Filed: Oct. 18, 2021

(86) PCT No.: PCT/US2021/055384
§ 371 (c)(1),
(2) Date: Apr. 14, 2023

(87) PCT Pub. No.: WO2022/082094
PCT Pub. Date: Apr. 21, 2022

(65) Prior Publication Data

US 2023/0408152 A1 Dec. 21, 2023

Related U.S. Application Data

(60) Provisional application No. 63/092,580, filed on Oct. 16, 2020.

(51) Int. Cl.
*F25B 6/04* (2006.01)
*F25B 9/00* (2006.01)
*F25B 9/10* (2006.01)

(52) U.S. Cl.
CPC ..... *F25B 6/04* (2013.01); *F25B 9/006* (2013.01); *F25B 9/10* (2013.01);
(Continued)

(58) Field of Classification Search
CPC .... F25B 6/04; F25B 9/006; F25B 9/10; F25B 2600/2501; F25B 2700/2103;
(Continued)

(56) References Cited

U.S. PATENT DOCUMENTS 4,238,933 A 12/1980 Coombs
6,347,528 B1 * 2/2002 Iritani ..... B60H 1/3207 62/434
(Continued)

FOREIGN PATENT DOCUMENTS

CN 106440512 A * 2/2017 ..... F25B 30/02
CN 110131934 A * 8/2019 ..... F25B 47/022
(Continued)

OTHER PUBLICATIONS

International Search Report and Written Opinion in related International Application No. PCT/US2021/055384, dated Mar. 31, 2022, 16 pages.
(Continued)

*Primary Examiner* — Kun Kai Ma
(74) *Attorney, Agent, or Firm* — Fish & Richardson P.C.

(57) ABSTRACT

A refrigeration system includes a refrigeration subsystem and a coolant subsystem. The refrigeration subsystem is configured to circulate a refrigerant between an evaporator (12,22) within which a refrigerant absorbs heat and a gas cooler/condenser (2) within which the refrigerant rejects heat to provide cooling to a temperature-controlled space. The coolant subsystem includes a heat exchanger (61) coupled to the refrigeration subsystem at an outlet of the gas cooler/condenser and configured to transfer heat from the refrigerant exiting the gas cooler/condenser to an external coolant when the external coolant flows through the heat exchanger, a control valve (64), and a controller (50) configured to operate the control valve to control a flow of at least one of the refrigerant or the external coolant through the heat exchanger based on a temperature of the external coolant relative to a temperature of the refrigerant exiting the gas cooler/condenser.

20 Claims, 5 Drawing Sheets

(52) U.S. Cl.
CPC ..... *F25B 2600/2501* (2013.01); *F25B 2700/2103* (2013.01); *F25B 2700/21163* (2013.01)

(58) Field of Classification Search
CPC .. F25B 2700/21163; F25B 41/20; F25B 5/02; F25B 41/24; F25B 41/39; F25B 2339/047; F25B 2400/0403; F25B 2400/0417; F25B 2400/23; F25B 2700/195; F25B 1/10; F25B 2700/21161; F25B 40/02; F25B 49/02; F25B 2400/13
See application file for complete search history.

(56) References Cited

U.S. PATENT DOCUMENTS

| | | | | |
|---|---|---|---|---|
| 8,631,666 | B2 | 1/2014 | Hinde et al. | |
| 9,377,236 | B2 | 6/2016 | Hinde et al. | |
| 9,470,435 | B2 | 10/2016 | Hinde et al. | |
| 9,689,590 | B2 | 6/2017 | Christensen | |
| 10,502,461 | B2 * | 12/2019 | Christensen | F25B 49/02 |
| 10,663,201 | B2 | 5/2020 | Hayes | |
| 2013/0091881 | A1 * | 4/2013 | Ito | H05K 7/20836 62/190 |
| 2014/0041826 | A1 * | 2/2014 | Takeuchi | B60L 1/08 165/10 |
| 2014/0245777 | A1 * | 9/2014 | Katoh | F28D 1/0435 165/172 |
| 2014/0305159 | A1 * | 10/2014 | Katoh | F28D 1/0435 165/157 |
| 2015/0338173 | A1 * | 11/2015 | Katoh | F28F 1/12 165/172 |
| 2016/0102901 | A1 | 4/2016 | Christensen et al. | |
| 2016/0186757 | A1 * | 6/2016 | Collins | F04C 18/16 418/83 |
| 2019/0368786 | A1 * | 12/2019 | Newel | F25B 40/02 |
| 2019/0376728 | A1 | 12/2019 | Hayes et al. | |
| 2020/0033039 | A1 | 1/2020 | Krishnamoorthy et al. | |
| 2020/0166248 | A1 * | 5/2020 | Kato | F25B 5/02 |

FOREIGN PATENT DOCUMENTS

| | | | | |
|---|---|---|---|---|
| CN | 110411059 | A * | 11/2019 | F25B 41/00 |
| CN | 110500809 | A * | 11/2019 | F25B 41/00 |
| CN | 111550944 | A * | 8/2020 | F25B 41/20 |
| CN | 120043264 | A * | 5/2025 | F25B 30/02 |
| DE | 2712110 | C2 | 2/1985 | |
| EP | 3199891 | | 8/2017 | |
| GB | 2566381 | | 3/2019 | |

OTHER PUBLICATIONS

Office Action in European Appln. No. 21805789.1, mailed on Jun. 13, 2025, 9 pages.

* cited by examiner

$CO_2$ REFRIGERATION SYSTEM WITH EXTERNAL COOLANT CONTROL

This application is a U.S. National Stage Application under 35 U.S.C. § 371 and claims the benefit of International Application No. PCT/US2021/055384 filed Oct. 18, 2021, which claims the benefit of priority to U.S. Provisional Patent Application No. 63/092,580 filed Oct. 16, 2020.

BACKGROUND

The present disclosure relates generally to a refrigeration system and more particularly to a refrigeration system that uses carbon dioxide (i.e., $CO_2$) as a refrigerant.

Refrigeration systems are often used to provide cooling to temperature controlled display devices (e.g. cases, merchandisers, etc.) in supermarkets and other similar facilities. Vapor compression refrigeration systems are a type of refrigeration system which provides such cooling by circulating a fluid refrigerant (e.g., a liquid and/or vapor) through a thermodynamic vapor compression cycle. In a vapor compression cycle, the refrigerant is typically compressed to a high temperature high pressure state (e.g., by a compressor of the refrigeration system), cooled/condensed to a lower temperature state (e.g., in a gas cooler or condenser which absorbs heat from the refrigerant), expanded to a lower pressure (e.g., through an expansion valve), and evaporated to provide cooling by absorbing heat into the refrigerant. $CO_2$ refrigeration systems are a type of vapor compression refrigeration system that use $CO_2$ as a refrigerant.

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art and is not admitted to be prior art by inclusion in this section.

SUMMARY

One implementation of the present disclosure is a refrigeration system including a refrigeration subsystem and a coolant subsystem. The refrigeration subsystem is configured to circulate a refrigerant between an evaporator within which a refrigerant absorbs heat and a gas cooler/condenser within which the refrigerant rejects heat to provide cooling to a temperature-controlled space. The coolant subsystem includes a heat exchanger coupled to the refrigeration subsystem at an outlet of the gas cooler/condenser and configured to transfer heat from the refrigerant exiting the gas cooler/condenser to an external coolant when the external coolant flows through the heat exchanger, a control valve operable to control a flow of the external coolant through the heat exchanger, and a controller configured to operate the control valve to control the flow of the external coolant through the heat exchanger based on a temperature of the external coolant relative to a temperature of the refrigerant exiting the gas cooler/condenser.

In some embodiments, the refrigeration system includes a refrigerant temperature sensor located at the outlet of the gas cooler/condenser and configured to measure the temperature of the refrigerant exiting the gas cooler/condenser. In some embodiments, the refrigeration system includes a coolant temperature sensor located at a coolant inlet of the heat exchanger and configured to measure the temperature of the external coolant at the coolant inlet of the heat exchanger.

In some embodiments, the controller is configured to operate the control valve to increase the flow of the external coolant through the heat exchanger in response to a determination that the temperature of the external coolant is less than the temperature of the refrigerant within the fluid conduit. In some embodiments, the controller is configured to operate the control valve to decrease the flow of the external coolant through the heat exchanger in response to a determination that the temperature of the external coolant is greater than or equal to than the temperature of the refrigerant within the fluid conduit.

In some embodiments, the coolant subsystem includes an external coolant line configured to deliver the external coolant to the heat exchanger. In some embodiments, the control valve is located along the external coolant line in parallel with the heat exchanger such that closing the control valve causes the external coolant to flow through the heat exchanger and opening the control valve causes the external coolant to bypass the heat exchanger.

In some embodiments, the controller is configured to determine whether supplemental cooling of the refrigerant is available by comparing the temperature of the external coolant to the temperature of the refrigerant exiting the gas cooler/condenser, generate a valve setpoint for the control valve based on whether the supplemental cooling is available, and operate the control valve to achieve the valve setpoint.

In some embodiments, the external coolant includes at least one of water received from a city or municipal water supply for a building in which the refrigeration system is installed or rain water collected from rainfall at the building in which the refrigeration system is installed.

Another implementation of the present disclosure is a refrigeration system including an evaporator within which a refrigerant absorbs heat, a gas cooler/condenser within which the refrigerant rejects heat, a fluid conduit attached to an inlet of the gas cooler/condenser or an outlet of the gas cooler/condenser to direct the refrigerant into the gas cooler/condenser or out of the gas cooler/condenser, a heat exchanger coupled to the fluid conduit and within which heat is transferred from the refrigerant in the fluid conduit to an external coolant when the external coolant flows through the heat exchanger, a control valve operable to control a flow of the external coolant through the heat exchanger, and a controller configured to operate the control valve to control the flow of the external coolant through the heat exchanger based on a temperature of the external coolant relative to a temperature of the refrigerant within the fluid conduit.

In some embodiments, the fluid conduit is coupled to the outlet of the gas cooler/condenser and configured to direct the refrigerant out of the gas cooler/condenser through the heat exchanger.

In some embodiments, the fluid conduit is coupled to the inlet of the gas cooler/condenser and configured to direct the refrigerant from the heat exchanger through the gas cooler/condenser.

In some embodiments, the refrigeration system includes a refrigerant temperature sensor located along the fluid conduit at a refrigerant inlet of the heat exchanger and configured to measure the temperature of the refrigerant at the refrigerant inlet of the heat exchanger. In some embodiments, the refrigeration system includes a coolant temperature sensor located at a coolant inlet of the heat exchanger and configured to measure the temperature of the external coolant at the coolant inlet of the heat exchanger.

In some embodiments, the controller is configured to operate the control valve to increase the flow of the external coolant through the heat exchanger in response to a determination that the temperature of the external coolant is less than the temperature of the refrigerant within the fluid conduit. In some embodiments, the controller is configured to operate the control valve to decrease the flow of the external coolant through the heat exchanger in response to a determination that the temperature of the external coolant is greater than or equal to than the temperature of the refrigerant within the fluid conduit.

In some embodiments, the refrigeration system includes an external coolant line configured to deliver the external coolant to the heat exchanger. In some embodiments, the control valve is located along the external coolant line in parallel with the heat exchanger such that closing the control valve causes the external coolant to flow through the heat exchanger and opening the control valve causes the external coolant to bypass the heat exchanger.

In some embodiments, the controller is configured to determine whether supplemental cooling of the refrigerant is available by comparing the temperature of the external coolant to the temperature of the refrigerant within the fluid conduit, generate a valve setpoint for the control valve based on whether the supplemental cooling is available, and operate the control valve to achieve the valve setpoint.

Another implementation of the present disclosure is a method for operating a refrigeration system. The method includes circulating a refrigerant between an evaporator within which the refrigerant absorbs heat and a gas cooler/condenser within which the refrigerant rejects heat to provide cooling to a temperature-controlled space, directing the refrigerant into the gas cooler/condenser or out of the gas cooler/condenser via a fluid conduit, operating a control valve to control a flow of an external coolant through a heat exchanger coupled to the fluid conduit based on a temperature of the external coolant relative to a temperature of the refrigerant within the fluid conduit, and transferring heat from the refrigerant in the fluid conduit to the external coolant within the heat exchanger when the external coolant flows through the heat exchanger.

In some embodiments, the fluid conduit is coupled to the outlet of the gas cooler/condenser and directing the refrigerant comprises directing the refrigerant from the outlet of the gas cooler/condenser through the heat exchanger.

In some embodiments, the fluid conduit is coupled to the inlet of the gas cooler/condenser and directing the refrigerant comprises directing the refrigerant from the heat exchanger to the inlet of the gas cooler/condenser.

In some embodiments, measuring the temperature of the refrigerant within the fluid conduit at a refrigerant inlet of the heat exchanger using a refrigerant temperature sensor located at the refrigerant inlet of the heat exchanger. In some embodiments, measuring the temperature of the external coolant using a coolant temperature sensor located at a coolant inlet of the heat exchanger.

In some embodiments, operating the control valve includes operating the control valve to increase the flow of the external coolant through the heat exchanger in response to a determination that the temperature of the external coolant is less than the temperature of the refrigerant within the fluid conduit. In some embodiments, operating the control valve includes operating the control valve to decrease the flow of the external coolant through the heat exchanger in response to a determination that the temperature of the external coolant is greater than or equal to the temperature of the refrigerant within the fluid conduit.

In some embodiments, the method includes delivering the external coolant to the heat exchanger via an external coolant line. In some embodiments, the control valve is located along the external coolant line in parallel with the heat exchanger such that closing the control valve causes the external coolant to flow through the heat exchanger and opening the control valve causes the external coolant to bypass the heat exchanger.

In some embodiments, the method includes determining whether supplemental cooling of the refrigerant is available by comparing the temperature of the external coolant to the temperature of the refrigerant within the fluid conduit, generating a valve setpoint for the control valve based on whether the supplemental cooling is available, and operating the control valve to achieve the valve setpoint.

The foregoing is a summary and thus by necessity contains simplifications, generalizations, and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Overview

Figure 1:
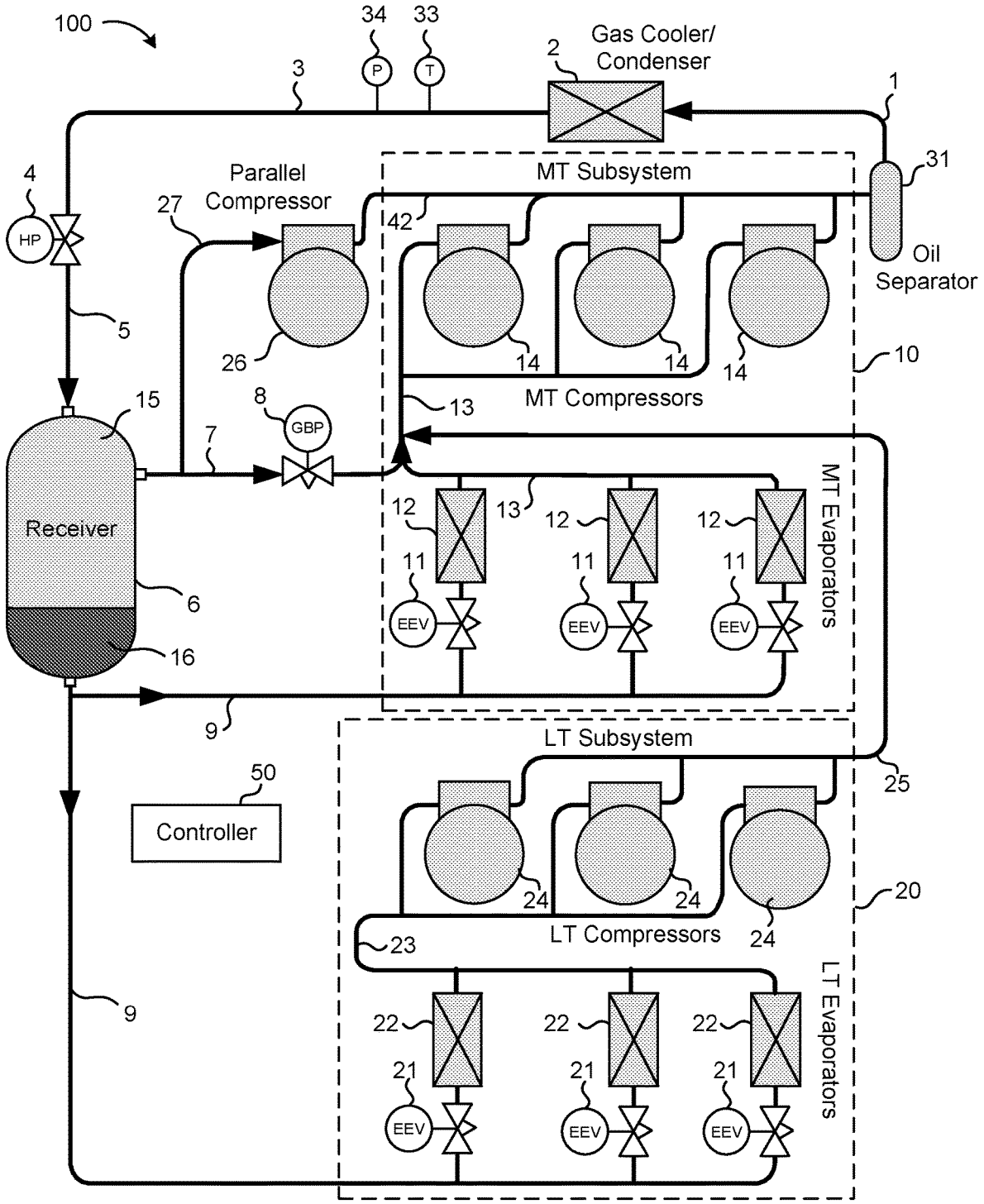
FIG. 1 is a block diagram of a $CO_2$ refrigeration system, according to an exemplary embodiment.

Referring generally to the FIGURES, a $CO_2$ refrigeration system is shown, according to various exemplary embodiments. The $CO_2$ refrigeration system may be a vapor compression refrigeration system which uses primarily carbon dioxide (i.e., $CO_2$) as a refrigerant. The $CO_2$ refrigeration system may circulate the refrigerant between an evaporator and a gas cooler/condenser to provide cooling to a temperature-controlled space (e.g., a refrigerator, a freezer, a temperature-controlled display case, etc.). The $CO_2$ refrigerant may absorb heat in the evaporator and reject heat in the gas cooler/condenser as the $CO_2$ refrigerant flows through the refrigeration circuit.

The $CO_2$ refrigeration system may include a coolant subsystem. In some embodiments, the coolant system includes a heat exchanger fluidly coupled to the refrigeration circuit downstream of the gas cooler/condenser such that the heat exchanger receives the cooled and/or condensed $CO_2$ refrigerant discharged from the gas cooler/condenser. In other embodiments, the heat exchanger may be located upstream of the gas cooler/condenser or otherwise located within the $CO_2$ refrigeration system. The heat exchanger may also receive an external coolant from an external coolant line and may operate to transfer heat from the $CO_2$ refrigerant to the external coolant when the external coolant flows through the heat exchanger.

The external coolant line can be connected to any of a variety of external coolant sources. In some embodiments, the external coolant line is a building water supply line that receives water from a city or municipal water supply. The water supplied via the external coolant line may be the same as the water used for other purposes within the building (e.g., sinks, food preparation, bathroom fixtures, drinking fountains, fire suppression, etc.). For example, the same plumbing system that provides water to sinks, drinking fountains, bathroom fixtures, and other locations at which water is used within the building may be connected to the external coolant line to provide water to the heat exchanger. Water received from a city or municipal water supply typically has a temperature of approximately 55° F.-75° F., which may be significantly colder than the temperature of the $CO_2$ refrigerant exiting the gas cooler/condenser. For example, the temperature of the $CO_2$ refrigerant exiting the gas cooler/condenser may be approximately 95° F. or higher during summer months. The temperature difference between the $CO_2$ refrigerant exiting the gas cooler/condenser and the temperature of the water supply provides an opportunity to cool the $CO_2$ refrigerant in the heat exchanger without running additional chillers or consuming a significant amount of additional energy. Alternatively, the external coolant may be collected rainwater, glycol, chilled water, or any other coolant.

A controller may operate a control valve to control a flow of the external coolant through the heat exchanger. For example, the controller may operate the control valve to cause the external coolant to flow through the heat exchanger when the temperature $T_1$ of the $CO_2$ refrigerant exceeds the temperature $T_2$ of the external coolant, thereby providing supplemental cooling for the $CO_2$ refrigerant by transferring heat from the $CO_2$ refrigerant to the external coolant within the heat exchanger. Conversely, the controller may operate the control valve to prevent the external coolant from flowing through the heat exchanger when the temperature $T_1$ of the $CO_2$ refrigerant is greater than or equal to the temperature $T_2$ of the external coolant, thereby preventing heat exchange from occurring between the $CO_2$ refrigerant and the external coolant. These and other features of the $CO_2$ refrigeration system are described in greater detail below.

$CO_2$ Refrigeration System

Referring now to FIG. 1, a $CO_2$ refrigeration system 100 is shown, according to an exemplary embodiment. $CO_2$ refrigeration system 100 may be a vapor compression refrigeration system which uses primarily carbon dioxide ($CO_2$) as a refrigerant. However, it is contemplated that other refrigerants can be substituted for $CO_2$ without departing from the teachings of the present disclosure. $CO_2$ refrigeration system 100 and is shown to include a system of pipes, conduits, or other fluid channels (e.g., fluid conduits 1, 3, 5, 7, 9, 13, 23, 27, and 42) for transporting the $CO_2$ refrigerant between various components of $CO_2$ refrigeration system 100. The components of $CO_2$ refrigeration system 100 are shown to include a gas cooler/condenser 2, a high pressure valve 4, a receiver 6, a gas bypass valve 8, a medium-temperature ("MT") subsystem 10, and a low-temperature ("LT") subsystem 20. The components of $CO_2$ refrigeration system 100 form a refrigeration circuit configured to circulate the $CO_2$ refrigerant and provide cooling for a temperature-controlled space (e.g., a refrigerator, a freezer, a refrigerated display case, etc.).

Gas cooler/condenser 2 may be a heat exchanger or other similar device for removing heat from the $CO_2$ refrigerant. Gas cooler/condenser 2 is shown receiving $CO_2$ vapor from fluid conduit 1. In some embodiments, the $CO_2$ vapor in fluid conduit 1 may have a pressure within a range from approximately 45 bar to approximately 100 bar (i.e., about 640 psig to about 1420 psig), depending on ambient temperature and other operating conditions. In some embodiments, gas cooler/condenser 2 may partially or fully condense $CO_2$ vapor into liquid $CO_2$ (e.g., if system operation is in a subcritical region). The condensation process may result in fully saturated $CO_2$ liquid or a liquid-vapor mixture (e.g., having a thermodynamic quality between 0 and 1). In other embodiments, gas cooler/condenser 2 may cool the $CO_2$ vapor (e.g., by removing superheat) without condensing the $CO_2$ vapor into $CO_2$ liquid (e.g., if system operation is in a supercritical region). In some embodiments, the cooling/condensation process is an isobaric process. Gas cooler/condenser 2 is shown outputting the cooled and/or condensed $CO_2$ refrigerant into fluid conduit 3.

In some embodiments, $CO_2$ refrigeration system 100 includes a temperature sensor 33 and/or a pressure sensor 34 configured to measure the temperature and pressure of the $CO_2$ refrigerant at the outlet of gas cooler/condenser 2. Sensors 33 and 34 can be installed along fluid conduit 3 (as shown in FIG. 1), within gas cooler/condenser 2, or otherwise positioned to measure the temperature and/or pressure of the $CO_2$ refrigerant exiting gas cooler/condenser 2.

High pressure valve 4 may receive the cooled and/or condensed $CO_2$ refrigerant from fluid conduit 3 and may discharge the $CO_2$ refrigerant to fluid conduit 5. High pressure valve 4 may control the pressure of the $CO_2$ refrigerant in gas cooler/condenser 2 by controlling an amount of $CO_2$ refrigerant permitted to pass through high pressure valve 4. In some embodiments, high pressure valve 4 is a high pressure thermal expansion valve (e.g., if the pressure in fluid conduit 3 is greater than the pressure in fluid conduit 5). In such embodiments, high pressure valve 4 may allow the $CO_2$ refrigerant to expand to a lower pressure state. The expansion process may be an isenthalpic and/or adiabatic expansion process, resulting in a flash evaporation of the high pressure $CO_2$ refrigerant to a lower pressure, lower temperature state. The expansion process may produce a liquid/vapor mixture (e.g., having a thermodynamic quality between 0 and 1). In some embodiments, the $CO_2$ refrigerant expands to a pressure of approximately 38 bar (e.g., about 540 psig), which corresponds to a temperature of approximately 37° F. The $CO_2$ refrigerant then flows from fluid conduit 5 into receiver 6. High pressure valve 4 can be operated automatically by controller 50, as described in greater detail with reference to FIG. 2A.

Receiver 6 may collect the $CO_2$ refrigerant from fluid conduit 5. In some embodiments, receiver 6 is a flash tank or other fluid reservoir. Receiver 6 is shown to include a $CO_2$ liquid portion 16 and a $CO_2$ vapor portion 15 and may contain a partially saturated mixture of $CO_2$ liquid and $CO_2$ vapor. In some embodiments, receiver 6 separates the $CO_2$ liquid from the $CO_2$ vapor. The $CO_2$ liquid may exit receiver 6 through fluid conduits 9. Fluid conduits 9 may be liquid headers leading to MT subsystem 10 and/or LT subsystem 20. The $CO_2$ vapor may exit receiver 6 through fluid conduit 7. Fluid conduit 7 is shown leading the $CO_2$ vapor to a gas bypass valve 8 and a parallel compressor 26 (described in greater detail below).

Still referring to FIG. 1, MT subsystem 10 is shown to include one or more expansion valves 11, one or more MT evaporators 12, and one or more MT compressors 14. In various embodiments, any number of expansion valves 11, MT evaporators 12, and MT compressors 14 may be present. Expansion valves 11 may be electronic expansion valves or other similar expansion valves. Expansion valves 11 are shown receiving liquid $CO_2$ refrigerant from fluid conduit 9 and outputting the $CO_2$ refrigerant to MT evaporators 12. Expansion valves 11 may cause the $CO_2$ refrigerant to undergo a rapid drop in pressure, thereby expanding the $CO_2$ refrigerant to a lower pressure, lower temperature state. In some embodiments, expansion valves 11 may expand the $CO_2$ refrigerant to a pressure of approximately 30 bar. The expansion process may be an isenthalpic and/or adiabatic expansion process.

MT evaporators 12 are shown receiving the cooled and expanded $CO_2$ refrigerant from expansion valves 11. In some embodiments, MT evaporators may be associated with display cases/devices (e.g., if $CO_2$ refrigeration system 100 is implemented in a supermarket setting). MT evaporators 12 may be configured to facilitate the transfer of heat from the display cases/devices into the $CO_2$ refrigerant. The added heat may cause the $CO_2$ refrigerant to evaporate partially or completely. According to one embodiment, the $CO_2$ refrigerant is fully evaporated in MT evaporators 12. In some embodiments, the evaporation process may be an isobaric process. MT evaporators 12 are shown outputting the $CO_2$ refrigerant via suction line 13, leading to MT compressors 14.

MT compressors 14 may operate to compress the $CO_2$ refrigerant into a superheated vapor having a pressure within a range of approximately 45 bar to approximately 100 bar. The output pressure from MT compressors 14 may vary depending on ambient temperature and other operating conditions. In some embodiments, MT compressors 14 operate in a transcritical mode. In operation, the $CO_2$ discharge gas exits MT compressors 14 and flows through fluid conduit 1 into gas cooler/condenser 2. In some embodiments, an oil separator 31 is located along fluid conduit 1 and configured to separate oil from the $CO_2$ discharge gas exiting MT compressors 14. The separated oil may be collected within oil separator 31 and returned to MT compressors 14 and/or LT compressors 24.

Still referring to FIG. 1, LT subsystem 20 is shown to include one or more expansion valves 21, one or more LT evaporators 22, and one or more LT compressors 24. In various embodiments, any number of expansion valves 21, LT evaporators 22, and LT compressors 24 may be present. In some embodiments, LT subsystem 20 may be omitted and the $CO_2$ refrigeration system 100 may operate with an AC module or parallel compressor 26 interfacing with only MT subsystem 10.

Expansion valves 21 may be electronic expansion valves or other similar expansion valves. Expansion valves 21 are shown receiving liquid $CO_2$ refrigerant from fluid conduit 9 and outputting the $CO_2$ refrigerant to LT evaporators 22. Expansion valves 21 may cause the $CO_2$ refrigerant to undergo a rapid drop in pressure, thereby expanding the $CO_2$ refrigerant to a lower pressure, lower temperature state. The expansion process may be an isenthalpic and/or adiabatic expansion process. In some embodiments, expansion valves 21 may expand the $CO_2$ refrigerant to a lower pressure than expansion valves 11, thereby resulting in a lower temperature $CO_2$ refrigerant. Accordingly, LT subsystem 20 may be used in conjunction with a freezer system or other lower temperature display cases.

LT evaporators 22 are shown receiving the cooled and expanded $CO_2$ refrigerant from expansion valves 21. In some embodiments, LT evaporators may be associated with display cases/devices (e.g., if $CO_2$ refrigeration system 100 is implemented in a supermarket setting). LT evaporators 22 may be configured to facilitate the transfer of heat from the display cases/devices into the $CO_2$ refrigerant. The added heat may cause the $CO_2$ refrigerant to evaporate partially or completely. In some embodiments, the evaporation process may be an isobaric process. LT evaporators 22 are shown outputting the $CO_2$ refrigerant via suction line 23, leading to LT compressors 24.

LT compressors 24 may operate to compress the $CO_2$ refrigerant. In some embodiments, LT compressors 24 may compress the $CO_2$ refrigerant to a pressure of approximately 30 bar (e.g., about 425 psig) having a saturation temperature of approximately 23° F. (e.g., about −5° C.). In some embodiments, LT compressors 24 operate in a subcritical mode. LT compressors 24 are shown outputting the $CO_2$ refrigerant through discharge line 25. Discharge line 25 may be fluidly connected with the suction (e.g., upstream) side of MT compressors 14 (e.g., suction line 13).

Still referring to FIG. 1, $CO_2$ refrigeration system 100 is shown to include a gas bypass valve 8. Gas bypass valve 8 may receive the $CO_2$ vapor from fluid conduit 7 and output the $CO_2$ refrigerant to MT subsystem 10. In some embodiments, gas bypass valve 8 is arranged in series with MT compressors 14. In other words, $CO_2$ vapor from receiver 6 may pass through both gas bypass valve 8 and MT compressors 14. MT compressors 14 may compress the $CO_2$ vapor passing through gas bypass valve 8 from a low pressure state (e.g., approximately 30 bar or lower) to a high pressure state (e.g., 45-100 bar).

Gas bypass valve 8 may be operated by controller 50 to regulate or control the pressure within receiver 6 (e.g., by adjusting an amount of $CO_2$ refrigerant permitted to pass through gas bypass valve 8). For example, gas bypass valve 8 may be adjusted (e.g., variably opened or closed) to adjust the mass flow rate, volume flow rate, or other flow rates of the $CO_2$ refrigerant through gas bypass valve 8. Gas bypass valve 8 may be opened and closed (e.g., manually, automatically, by a controller, etc.) as needed to regulate the pressure within receiver 6.

In some embodiments, gas bypass valve 8 includes a sensor for measuring a flow rate (e.g., mass flow, volume flow, etc.) of the $CO_2$ refrigerant through gas bypass valve 8. In other embodiments, gas bypass valve 8 includes an indicator (e.g., a gauge, a dial, etc.) from which the position of gas bypass valve 8 may be determined. This position may be used to determine the flow rate of $CO_2$ refrigerant through gas bypass valve 8, as such quantities may be proportional or otherwise related.

In some embodiments, gas bypass valve 8 may be a thermal expansion valve (e.g., if the pressure on the downstream side of gas bypass valve 8 is lower than the pressure in fluid conduit 7). According to one embodiment, the pressure within receiver 6 is regulated by gas bypass valve 8 to a pressure of approximately 38 bar, which corresponds to about 37° F. Advantageously, this pressure/temperature state may facilitate the use of copper tubing/piping for the downstream $CO_2$ lines of the system. Additionally, this pressure/temperature state may allow such copper tubing to operate in a substantially frost-free manner.

In some embodiments, the $CO_2$ vapor that is bypassed through gas bypass valve 8 is mixed with the $CO_2$ refrigerant gas exiting MT evaporators 12 (e.g., via suction line 13). The bypassed $CO_2$ vapor may also mix with the discharge $CO_2$ refrigerant gas exiting LT compressors 24 (e.g., via discharge line 25). The combined $CO_2$ refrigerant gas may be provided to the suction side of MT compressors 14.

In some embodiments, the pressure immediately downstream of gas bypass valve 8 (i.e., in suction line 13) is lower than the pressure immediately upstream of gas bypass valve 8 (i.e., in fluid conduit 7). Therefore, the $CO_2$ vapor passing through gas bypass valve 8 and MT compressors 14 may be expanded (e.g., when passing through gas bypass valve 8) and subsequently recompressed (e.g., by MT compressors 14). This expansion and recompression may occur without any intermediate transfers of heat to or from the $CO_2$ refrigerant, which can be characterized as an inefficient energy usage.

Still referring to FIG. 1, $CO_2$ refrigeration system 100 is shown to include a parallel compressor 26. Parallel compressor 26 may be arranged in parallel with other compressors of $CO_2$ refrigeration system 100 (e.g., MT compressors 14, LT compressors 24, etc.). Although only one parallel compressor 26 is shown, any number of parallel compressors may be present. Parallel compressor 26 may be fluidly connected with receiver 6 and/or fluid conduit 7 via a connecting line 27. Parallel compressor 26 may be used to draw non-condensed $CO_2$ vapor from receiver 6 as a means for pressure control and regulation. Advantageously, using parallel compressor 26 to effectuate pressure control and regulation may provide a more efficient alternative to traditional pressure regulation techniques such as bypassing $CO_2$ vapor through bypass valve 8 to the lower pressure suction side of MT compressors 14.

In some embodiments, parallel compressor 26 may be operated (e.g., by a controller 50) to achieve a desired pressure within receiver 6. For example, controller 50 may receive pressure measurements from a pressure sensor monitoring the pressure within receiver 6 and may activate or deactivate parallel compressor 26 based on the pressure measurements. When active, parallel compressor 26 compresses the $CO_2$ vapor received via connecting line 27 and discharges the compressed vapor into discharge line 42. Discharge line 42 may be fluidly connected with fluid conduit 1. Accordingly, parallel compressor 26 may operate in parallel with MT compressors 14 by discharging the compressed $CO_2$ vapor into a shared fluid conduit (e.g., fluid conduit 1).

Parallel compressor 26 may be arranged in parallel with both gas bypass valve 8 and with MT compressors 14. $CO_2$ vapor exiting receiver 6 may pass through either parallel compressor 26 or the series combination of gas bypass valve 8 and MT compressors 14. Parallel compressor 26 may receive the $CO_2$ vapor at a relatively higher pressure (e.g., from fluid conduit 7) than the $CO_2$ vapor received by MT compressors 14 (e.g., from suction line 13). This differential in pressure may correspond to the pressure differential across gas bypass valve 8. In some embodiments, parallel compressor 26 may require less energy to compress an equivalent amount of $CO_2$ vapor to the high pressure state (e.g., in fluid conduit 1) as a result of the higher pressure of $CO_2$ vapor entering parallel compressor 26. Therefore, the parallel route including parallel compressor 26 may be a more efficient alternative to the route including gas bypass valve 8 and MT compressors 14.

In some embodiments, gas bypass valve 8 is omitted and the pressure within receiver 6 is regulated using parallel compressor 26. In other embodiments, parallel compressor 26 is omitted and the pressure within receiver 6 is regulated using gas bypass valve 8. In other embodiments, both gas bypass valve 8 and parallel compressor 26 are used to regulate the pressure within receiver 6. All such variations are within the scope of the present disclosure.

$CO_2$ Refrigeration System with External Coolant Control

Figure 2A:
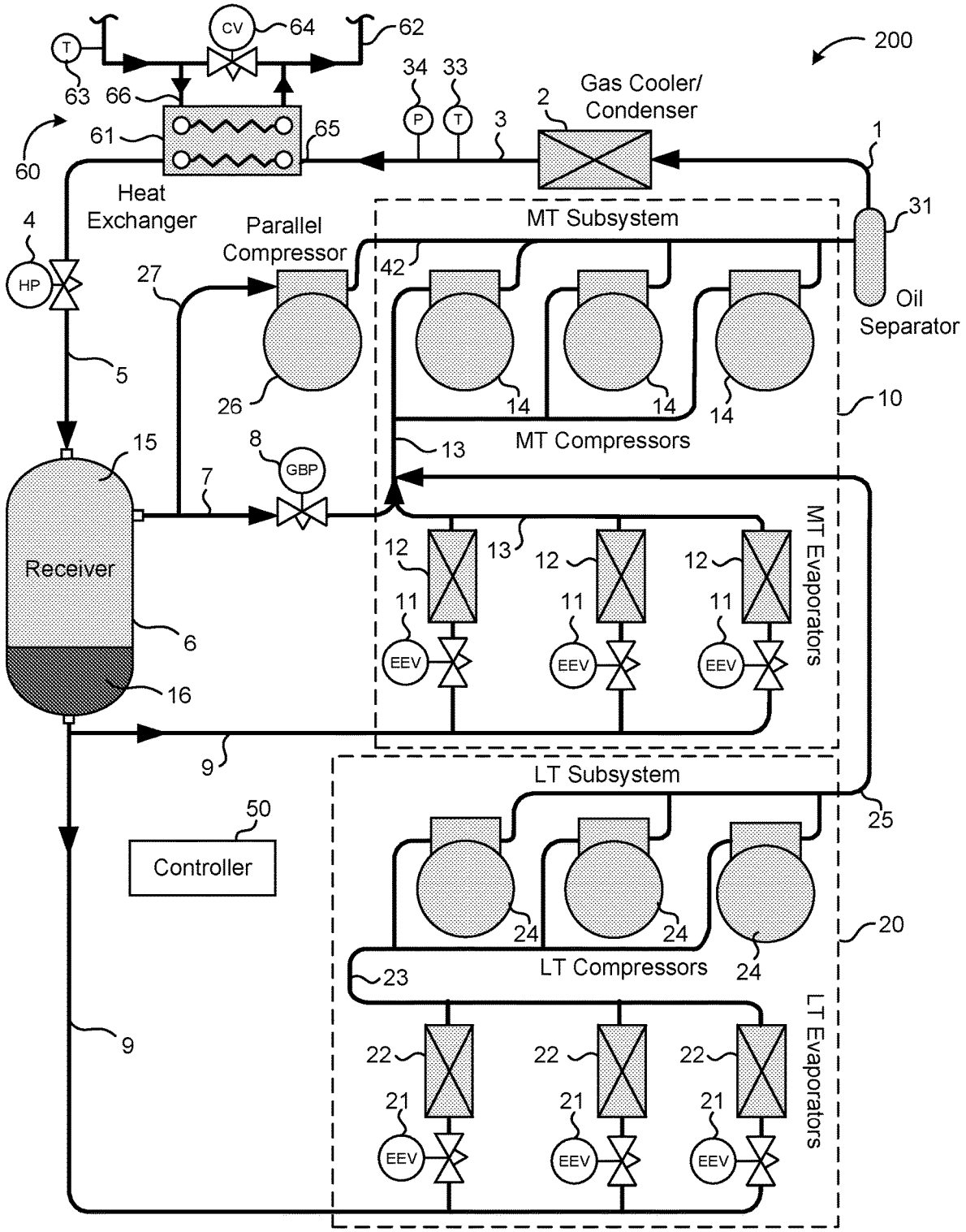
FIG. 2A is a block diagram of a $CO_2$ refrigeration system with a coolant subsystem, according to an exemplary embodiment.

Referring now to FIG. 2A, another $CO_2$ refrigeration system 200 is shown, according to an exemplary embodiment. $CO_2$ refrigeration system 200 is shown to include many of the same components and devices as $CO_2$ refrigeration system 100. These components and devices of $CO_2$ refrigeration system 200 may be the same as or similar to the like-numbered components and devices of $CO_2$ refrigeration system 100 and may operate in the same or similar manner as described with reference to FIG. 1. Accordingly, some or all of the features and/or functionality of $CO_2$ refrigeration system 100 may be present in $CO_2$ refrigeration system 200 as well. Like $CO_2$ refrigeration system 100, the components of $CO_2$ refrigeration system 200 form a refrigeration circuit configured to circulate the $CO_2$ refrigerant and provide cooling for a temperature-controlled space (e.g., a refrigerator, a freezer, a refrigerated display case, etc.). In the context of $CO_2$ refrigeration system 200, the components that are shared between $CO_2$ refrigeration system 100 and $CO_2$ refrigeration system 200 may be referred to as a refrigeration subsystem.

$CO_2$ refrigeration system 200 is also shown to include a coolant subsystem 60. Coolant subsystem 60 may be referred to as coolant circuit or coolant subsystem throughout the present disclosure. Coolant system 60 is shown to include a heat exchanger 61. In some embodiments, heat exchanger 61 is fluidly coupled to fluid conduit 3 (e.g., located along fluid conduit 3, connected to fluid conduit 3 via connecting lines, etc.) such that heat exchanger 61 receives the cooled and/or condensed $CO_2$ refrigerant discharged from gas cooler/condenser 2. Heat exchanger 61 may receive the $CO_2$ refrigerant exiting gas cooler/condenser 2 at a first inlet 65 of heat exchanger 61 (e.g., the bottom right inlet shown in FIG. 2A). In other embodiments, heat exchanger 61 may be fluidly coupled to fluid conduit 5 downstream of high pressure valve 4, fluidly coupled to fluid conduit 1 upstream of gas cooler/condenser 2, or otherwise positioned within $CO_2$ refrigeration system 200 to receive a flow of the $CO_2$ refrigerant from any of the fluid conduits of $CO_2$ refrigeration system 200. In some embodiments, heat exchanger 61 is connected to the refrigeration circuit or refrigeration subsystem between MT compressors 14 and receiver 6 along one of fluid conduits 1, 3, or 5 such that heat exchanger 61 receives the hot compressed refrigerant discharged from MT compressors 14, either before or after the refrigerant passes through gas cooler/condenser 2 and/or high pressure valve 4.

Heat exchanger 61 may also be fluidly coupled to an external coolant line 62 (e.g., located along external coolant line 62, connected to external coolant line 62 via connecting lines, etc.). Heat exchanger 61 may receive an external coolant (e.g., water, glycol, etc.) at a second inlet 66 of heat exchanger 61 (e.g., the top left inlet shown in FIG. 2A). Both the external coolant and the $CO_2$ refrigerant may flow through heat exchanger 61 to allow for heat transfer therebetween. In operation, heat exchanger 61 may transfer heat from the $CO_2$ refrigerant to the external coolant flowing through heat exchanger 61, thereby providing additional cooling for the $CO_2$ refrigerant. Advantageously, the additional cooling provided by heat exchanger 61 may improve (i.e., increase) the overall efficiency of $CO_2$ refrigeration system 200 relative to $CO_2$ refrigeration system 100.

Heat exchanger 61 can be any of a variety of types of heat exchangers including, for example, a shell and tube heat exchanger, a plate heat exchanger, a plate and shell heat exchanger, a spiral heat exchanger, a tubular heat exchanger, or any other structure that places the external coolant and the $CO_2$ refrigerant in a heat exchange relationship with each other. In various embodiments, heat exchanger 61 may be configured to arrange the flows of the external coolant and the $CO_2$ refrigerant through heat exchanger 61 in a parallel-flow arrangement (e.g., both the external coolant and the $CO_2$ refrigerant enter heat exchanger 61 at the same side and travel parallel to one another in substantially the same direction to the other side), a counter-flow arrangement (e.g., the external coolant and the $CO_2$ refrigerant enter heat exchanger 61 at opposite sides and travel parallel to one another in substantially opposite directions to the other sides), a cross-flow arrangement (e.g., the external coolant and the $CO_2$ refrigerant travel substantially perpendicular to each other through heat exchanger 61), or any other flow arrangement.

External coolant line 62 can be connected to any of a variety of external coolant sources. In some embodiments, external coolant line 62 is a building water supply line that receives water from a city or municipal water supply. The water supplied via external coolant line 62 may be the same as the water used for other purposes within the building (e.g., sinks, food preparation, bathroom fixtures, drinking fountains, fire suppression, etc.). For example, the same plumbing system that provides water to sinks, drinking fountains, bathroom fixtures, and other locations at which water is used within the building may be connected to external coolant line 62 to provide water to heat exchanger 61. Water received from a city or municipal water supply typically has a temperature of approximately 55° F.-75° F., which may be significantly colder than the temperature of the $CO_2$ refrigerant exiting gas cooler/condenser 2. For example, the temperature of the $CO_2$ refrigerant exiting gas cooler/condenser 2 may be approximately 95° F. or higher during summer months. The temperature difference between the $CO_2$ refrigerant exiting gas cooler/condenser 2 and the temperature of the water supply provides an opportunity to cool the $CO_2$ refrigerant in heat exchanger 61 without running additional chillers or consuming a significant amount of additional energy.

In some embodiments, external coolant line 62 is a water supply line that receives water from a different water source such as reclaimed rain water or a chilled water system. In a chilled water system, one or more chillers may be coupled to external coolant line 62 and may operate to provide cooling to the water flowing through external coolant line 62. In other embodiments, external coolant line 62 is a glycol supply line that provides a flow of glycol through heat exchanger 61. In various embodiments, the external coolant may be water (e.g., city/municipal water, rain water, etc.), glycol, or any of a variety of other coolants (e.g., cutting fluid, mineral oils, polyphenyl ether oils, silicone oils, etc.). The external coolant may flow through external coolant line 62 as a result of pressure provided by an external source (e.g., a pressurized water line from a city or municipality, a water tower, etc.) and/or a fluid pump located along external coolant line 62 and configured to pump or circulate the external coolant through external coolant line 62. In some embodiments, a fluid pump may be included in coolant subsystem 60 (e.g., located along external coolant line 62) to cause the external coolant to circulate through external coolant line 62.

In some embodiments, the heat transferred from the $CO_2$ refrigerant to the external coolant may be used for other purposes inside the building. For example, the heated coolant exiting heat exchanger 61 may be delivered to a heater, air handling unit, damper, air duct, or otherwise exposed to airflow for the building to transfer heat from the heated coolant to the airflow. Other uses for the heated coolant may include circulating the heated coolant through a radiative heating system (e.g., a set of radiators), circulating the heated coolant through a heated flooring system, using the heated coolant to pre-heat water for a boiler or water heater for the building, or otherwise reclaiming the heat from the heated coolant.

Coolant subsystem 60 is shown to include a control valve 64 operable to control the flow rate of the external coolant through heat exchanger 61. In various embodiments, control valve 64 may be located along external coolant line 62 or along a connecting line that connects external coolant line 62 to heat exchanger 61. In the embodiment shown in FIG. 2A, control valve 64 is located along external coolant line 62 and arranged in parallel with heat exchanger 61. Accordingly, control valve can be opened to allow the external coolant to bypass heat exchanger 61 or closed to cause the external coolant to flow through heat exchanger 61. For embodiments in which control valve 64 is located along one of the connecting lines (e.g., in series with heat exchanger 61), control valve can be closed to prevent the external coolant from flowing through heat exchanger 61 or opened to allow the external coolant to flow through heat exchanger 61. In these or other suitable positions of control valve 64, the position of control valve 64 can be controlled to modulate or control the flow rate of the external coolant through heat exchanger 61. The position of control valve 64 may be set to any of a variety of positions including fully open (e.g., 100% open), fully closed (e.g., 0% open), and/or any intermediate position between fully open and fully closed (e.g., 20% open, 40% open, 60% open, 80% open, etc.).

In some embodiments, the position of control valve 64 is automatically controlled by a controller 50. For example, controller 50 may provide control signals to control valve 64 or to an actuator which operates to adjust the position of control valve 64 to cause control valve 64 to move into a desired position (i.e., a position setpoint). The position setpoint for control valve 64 may be automatically determined by controller 50 based on the temperatures of the external coolant and the $CO_2$ refrigerant. For example, coolant subsystem 60 is shown to include a temperature sensor 63 located along external coolant line 62 and configured to measure the temperature of the external coolant within external coolant line 62. Controller 50 may receive temperature measurements of the external coolant from temperature sensor 63 as well as temperature measurements of the $CO_2$ refrigerant from temperature sensor 33.

Temperature sensors 33 and 63 may be positioned to measure the temperature of the $CO_2$ refrigerant and the external coolant at or near heat exchanger 61. In some embodiments, temperature sensors 33 and 63 may be located upstream of heat exchanger 61 (e.g., along fluid conduit 3 and external coolant line 62, respectively, as shown in FIG. 2A) such that the temperature measurements of the $CO_2$ refrigerant and the external coolant from temperature sensors 33 and 63 reflect the temperatures of the fluids flowing into heat exchanger 61. In some embodiments, temperature sensor 33 may be located at an outlet of gas cooler/condenser 2 (e.g., along fluid conduit 3, between gas cooler/condenser 2 and heat exchanger 61, at a refrigerant inlet 65 of heat exchanger 61) such that temperature sensor 33 measures the temperature of the $CO_2$ refrigerant exiting gas cooler/condenser 2 and entering heat exchanger 61. For embodiments in which heat exchanger 61 is located upstream of gas cooler/condenser 2 (e.g., along fluid conduit 1), temperature sensor 33 may be located at an outlet of MT compressors 14 (e.g., along discharge line 42, between MT compressors 14 and heat exchanger 61, at a refrigerant inlet of heat exchanger 61) such that temperature sensor 33 measures the temperature of the $CO_2$ refrigerant exiting MT compressors 14 and entering heat exchanger 61. Temperature sensor 63 may be located along external coolant line 62, along a connecting line that connects external coolant line 62 to heat exchanger 61, at a coolant inlet of heat exchanger 61, or otherwise positioned to measure the temperature of the external coolant flowing into heat exchanger 61.

Although several examples of the locations of temperature sensors 33 and 63 are described herein, it is appreciated that the positions of temperature sensors 33 and 63 can be varied without departing from the teachings of the present disclosure. Additionally, any references to a temperature sensor being located "at" a particular location should be understood as any location at which the temperature measurements recorded by the temperature sensor can be expected to be the same as or similar to (e.g., ±1%, ±5%, ±10%, etc.), measurements recorded by a temperature sensor at the specified location. For example, a temperature sensor located "at" the outlet of gas cooler/condenser 2 may include a temperature sensor located close to the outlet of gas cooler/condenser 2, within gas cooler/condenser 2, along fluid conduit 3, at any location between gas cooler/condenser 2 and heat exchanger 61, at the refrigerant inlet of heat exchanger 61, or any other location at which the $CO_2$ refrigerant can be expected to have the same or similar temperature as the $CO_2$ refrigerant at the outlet of gas cooler/condenser 2. Similarly, a temperature sensor located "at" the coolant inlet of heat exchanger 61 may be located along external coolant line 62, along a connecting line that connects external coolant line 62 to heat exchanger 61, within heat exchanger 61 near the coolant inlet, at any location within coolant subsystem 60 upstream of heat exchanger 61, at a fresh water intake for the building, or otherwise positioned to measure a temperature that is expected to be the same as or similar to the temperature of the external coolant flowing into heat exchanger 61.

Figure 2B:
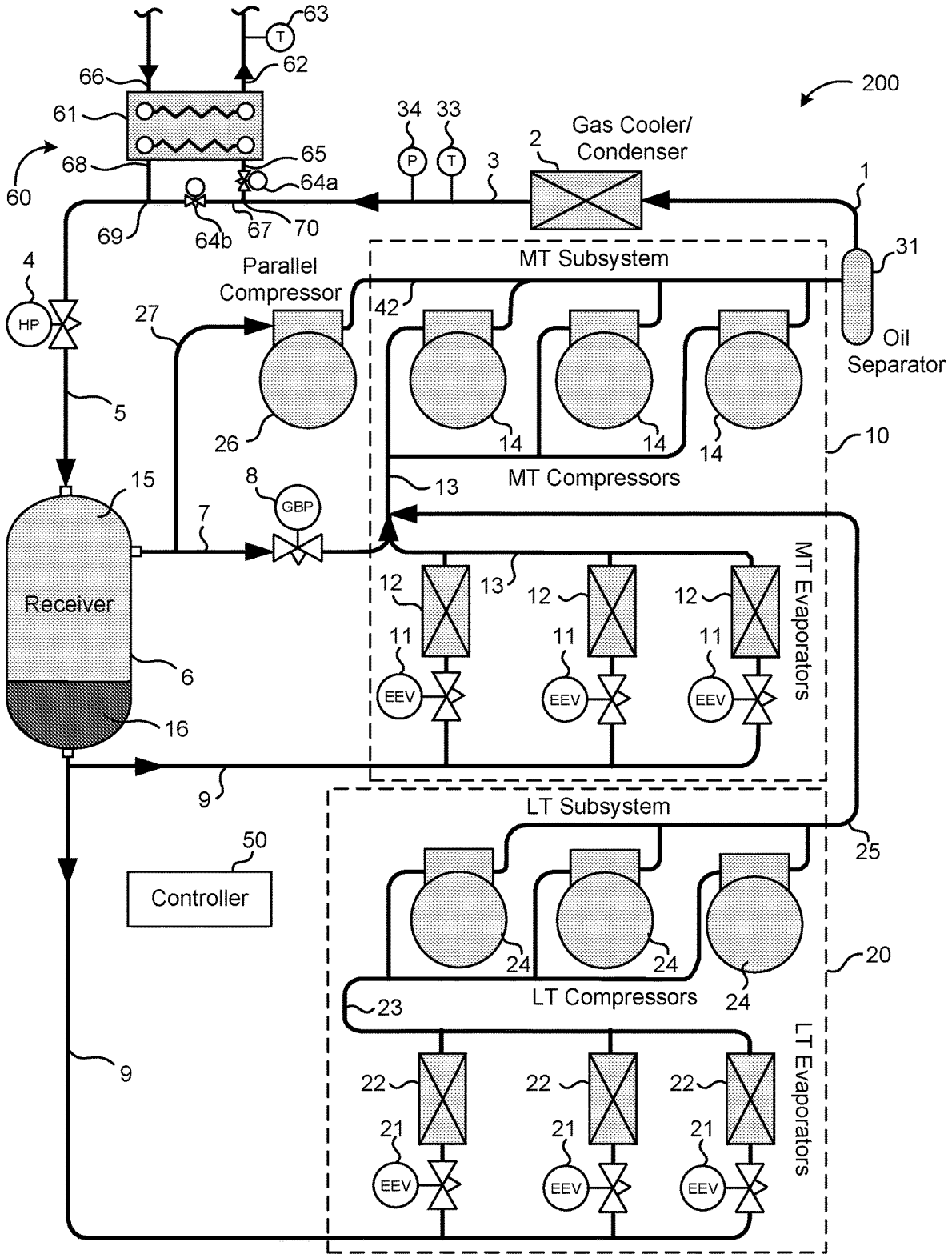
FIG. 2B is a block diagram of another $CO_2$ refrigeration system with a coolant subsystem, according to an exemplary embodiment.

Referring now to FIG. 2B, another $CO_2$ refrigeration system 200 is shown, according to an exemplary embodiment with another configuration of the coolant subsystem 60 where control valves 64*a* and 64*b* are operable to control the flow rate of the refrigerant through heat exchanger 61. The $CO_2$ refrigeration system 200 of FIG. 2B is shown to include many of the same components and devices as $CO_2$ refrigeration system 100. These components and devices of $CO_2$ refrigeration system 200 may be the same as or similar to the like-numbered components and devices of $CO_2$ refrigeration system 100 and 200 and may operate in the same or similar manner as described with reference to FIGS. 1 and 2A. Accordingly, some or all of the features and/or functionality of $CO_2$ refrigeration system 100 and 200 of FIG. 2A may be present in $CO_2$ refrigeration system 200 of FIG. 2B as well. Like $CO_2$ refrigeration system 100 and FIG. 2A, the components of $CO_2$ refrigeration system 200 of FIG. 2B form a refrigeration circuit configured to circulate the $CO_2$ refrigerant and provide cooling for a temperature-controlled space (e.g., a refrigerator, a freezer, a refrigerated display case, etc.). In the context of $CO_2$ refrigeration system 200 of FIG. 2B, the components that are shared between $CO_2$ refrigeration system 100, $CO_2$ refrigeration system 200 of FIG. 2A, and $CO_2$ refrigeration system 200 of FIG. 2B may be referred to as a refrigeration subsystem.

Referring to FIG. 2B, the $CO_2$ refrigeration system 200 is also shown to include a coolant subsystem 60. Coolant subsystem 60 may be referred to as coolant circuit or coolant subsystem throughout the present disclosure. Coolant system 60 is shown to include a heat exchanger 61. In some embodiments, heat exchanger 61 is fluidly coupled to fluid conduit 3 (e.g., located along fluid conduit 3, connected to fluid conduit 3 via connecting lines, etc.) such that heat exchanger 61 receives the cooled and/or condensed $CO_2$ refrigerant discharged from gas cooler/condenser 2. Heat exchanger 61 may receive the $CO_2$ refrigerant exiting gas cooler/condenser 2 at a first inlet 65 of heat exchanger 61 (e.g., the bottom right inlet shown in FIG. 2A). In other embodiments, heat exchanger 61 may be fluidly coupled to fluid conduit 5 downstream of high pressure valve 4, fluidly coupled to fluid conduit 1 upstream of gas cooler/condenser 2, or otherwise positioned within $CO_2$ refrigeration system 200 to receive a flow of the $CO_2$ refrigerant from any of the fluid conduits of $CO_2$ refrigeration system 200. In some embodiments, heat exchanger 61 is connected to the refrigeration circuit or refrigeration subsystem between MT compressors 14 and receiver 6 along one of fluid conduits 1, 3, or 5 such that heat exchanger 61 receives the hot compressed refrigerant discharged from MT compressors 14, either before or after the refrigerant passes through gas cooler/condenser 2 and/or high pressure valve 4.

Heat exchanger 61 may also be fluidly coupled to an external coolant line 62 (e.g., located along external coolant line 62, connected to external coolant line 62 via connecting lines, etc.). Heat exchanger 61 may receive an external coolant (e.g., air, water, glycol, etc.) at a second inlet 66 of heat exchanger 61 (e.g., the top left inlet shown in FIG. 2A). Both the external coolant and the $CO_2$ refrigerant may flow through heat exchanger 61 to allow for heat transfer therebetween. In operation, heat exchanger 61 may transfer heat from the $CO_2$ refrigerant to the external coolant flowing through heat exchanger 61, thereby providing additional cooling for the $CO_2$ refrigerant. Advantageously, the additional cooling provided by heat exchanger 61 may improve (i.e., increase) the overall efficiency of $CO_2$ refrigeration system 200 relative to $CO_2$ refrigeration system 100.

Heat exchanger 61 can be any of a variety of types of heat exchangers including, for example, liquid-to-air heat exchanger, a shell and tube heat exchanger, a plate heat exchanger, a plate and shell heat exchanger, a spiral heat exchanger, a tubular heat exchanger, or any other structure that places the external coolant and the $CO_2$ refrigerant in a heat exchange relationship with each other. In various embodiments, heat exchanger 61 may be configured to arrange the flows of the external coolant and the $CO_2$ refrigerant through heat exchanger 61 in a parallel-flow arrangement (e.g., both the external coolant and the $CO_2$ refrigerant enter heat exchanger 61 at the same side and travel parallel to one another in substantially the same direction to the other side), a counter-flow arrangement (e.g., the external coolant and the $CO_2$ refrigerant enter heat exchanger 61 at opposite sides and travel parallel to one another in substantially opposite directions to the other sides), a cross-flow arrangement (e.g., the external coolant and the $CO_2$ refrigerant travel substantially perpendicular to each other through heat exchanger 61), or any other flow arrangement.

External coolant line 62 can be connected to any of a variety of external coolant sources of fluid (e.g., air or liquid). In some embodiments, external coolant line 62 is a building water supply line that receives water from a city or municipal water supply. The water supplied via external coolant line 62 may be the same as the water used for other purposes within the building (e.g., sinks, food preparation, bathroom fixtures, drinking fountains, fire suppression, etc.). For example, the same plumbing system that provides water to sinks, drinking fountains, bathroom fixtures, and other locations at which water is used within the building may be connected to external coolant line 62 to provide water to heat exchanger 61. Water received from a city or municipal water supply typically has a temperature of approximately 55° F.-75° F., which may be significantly colder than the temperature of the $CO_2$ refrigerant exiting gas cooler/condenser 2. For example, the temperature of the $CO_2$ refrigerant exiting gas cooler/condenser 2 may be approximately 95° F. or higher during summer months. The temperature difference between the $CO_2$ refrigerant exiting gas cooler/condenser 2 and the temperature of the water supply provides an opportunity to cool the $CO_2$ refrigerant in heat exchanger 61 without running additional chillers or consuming a significant amount of additional energy.

In some embodiments, external coolant line 62 is a water supply line that receives water from a different water source such as reclaimed rain water or a chilled water system. In a chilled water system, one or more chillers may be coupled to external coolant line 62 and may operate to provide cooling to the water flowing through external coolant line 62. In other embodiments, external coolant line 62 is a glycol supply line that provides a flow of glycol through heat exchanger 61. In various embodiments, the external coolant may be water (e.g., city/municipal water, rain water, etc.), glycol, or any of a variety of other coolants (e.g., cutting fluid, mineral oils, polyphenyl ether oils, silicone oils, etc.). The external coolant may flow through external coolant line 62 as a result of pressure provided by an external source (e.g., a pressurized water line from a city or municipality, a water tower, etc.) and/or a fluid pump located along external coolant line 62 and configured to pump or circulate the external coolant through external coolant line 62. In some embodiments, a fluid pump may be included in coolant subsystem 60 (e.g., located along external coolant line 62) to cause the external coolant to circulate through external coolant line 62.

In some embodiments, the heat transferred from the $CO_2$ refrigerant to the external coolant may be used for other purposes inside the building. For example, the heated coolant exiting heat exchanger 61 may be delivered to a temperature-controlled space as an airflow, a heater, air handling unit, damper, air duct, or otherwise exposed to airflow for the building to transfer heat from the heated coolant to the airflow. Other uses for the heated coolant may include circulating the heated coolant through a radiative heating system (e.g., a set of radiators), circulating the heated coolant through a heated flooring system, using the heated coolant to pre-heat water for a boiler or water heater for the building, or otherwise reclaiming the heat from the heated coolant.

Coolant subsystem 60 is shown to include the control valves 64*a* and 64*b* which are operable to control the flow rate of the refrigerant through heat exchanger 61. In various embodiments, control valve 64*a* may be located along the first inlet 65 of the heat exchanger 61 downstream of the gas cooler/condenser 2. In various embodiments, control valve 64*b* may be located along a bypass 67 of fluid conduit 3 downstream of the first inlet 65 of the heat exchanger 61 and upstream of a refrigerant outlet 68 of the heat exchanger 61. The control valve 64*b* is arranged in parallel with the heat exchanger 61. Accordingly, the control valve 64*a* can be opened to allow the refrigerant to flow through heat exchanger 61 or closed to cause the external coolant to bypass heat exchanger 61. The control valve 64*b* can be closed to bypass the refrigerant to flow through heat exchanger 61 or opened to cause the refrigerant to flow through the bypass 67. In these or other suitable positions of control valves 64*a* and 64*b*, the position of control valves 64*a* and 64*b* can be controlled to modulate or control the flow rate of the refrigerant through heat exchanger 61 (or bypass 67, or both). The position of control valves 64*a* and 64*b* may be set to any of a variety of positions including fully open (e.g., 100% open), fully closed (e.g., 0% open), and/or any intermediate position between fully open and fully closed (e.g., 20% open, 40% open, 60% open, 80% open, etc.).

In some embodiments, the position of control valves 64*a* and 64*b* are automatically controlled by a controller 50. For example, controller 50 may provide control signals to control valves 64*a* and 64*b* or to an actuator which operates to adjust the position of control valves 64*a* and 64*b* to cause control valves 64*a* and 64*b* to move into a desired position (i.e., a position setpoint). The position setpoint for control valves 64*a* and 64*b* may be automatically determined by controller 50 based on the temperatures of the external coolant, the $CO_2$ refrigerant, or a combination thereof, such as a relative difference between such temperatures. For example, coolant subsystem 60 is shown to include a temperature sensor 63 located along external coolant line 62 and configured to measure the outlet temperature of the external coolant within external coolant line 62. Controller 50 may receive temperature measurements of the external coolant from temperature sensor 63 as well as temperature measurements of the $CO_2$ refrigerant from temperature sensor 33.

Temperature sensors 33 and 63 may be positioned to measure the temperature of the $CO_2$ refrigerant and the external coolant at or near heat exchanger 61. In some embodiments, temperature sensor 33 may be located upstream of heat exchanger 61 (e.g., along fluid conduit 3) such that the temperature measurements of the $CO_2$ refrigerant reflect the temperature of the refrigerant flowing into heat exchanger 61. In some embodiments, temperature sensor 33 may be located at an outlet of gas cooler/condenser 2 (e.g., along fluid conduit 3, between gas cooler/condenser 2 and heat exchanger 61, at a refrigerant inlet 65 of heat exchanger 61) such that temperature sensor 33 measures the temperature of the $CO_2$ refrigerant exiting gas cooler/condenser 2 and entering heat exchanger 61. For embodiments in which heat exchanger 61 is located upstream of gas cooler/condenser 2 (e.g., along fluid conduit 1), temperature sensor 33 may be located at an outlet of MT compressors 14 (e.g., along discharge line 42, between MT compressors 14 and heat exchanger 61, at a refrigerant inlet of heat exchanger 61) such that temperature sensor 33 measures the temperature of the $CO_2$ refrigerant exiting MT compressors 14 and entering heat exchanger 61. Temperature sensor 63 may be located along external coolant line 62 that connects heat exchanger 61 to, for example, a source to receive the heated external coolant (e.g., a temperature-controlled space, a heater, an air handling unit, and otherwise).

Although several examples of the locations of temperature sensors 33 and 63 are described herein, it is appreciated that the positions of temperature sensors 33 and 63 can be varied without departing from the teachings of the present disclosure. Additionally, any references to a temperature sensor being located "at" a particular location should be understood as any location at which the temperature measurements recorded by the temperature sensor can be expected to be the same as or similar to (e.g., ±1%, ±5%, ±10%, etc.), measurements recorded by a temperature sensor at the specified location. For example, a temperature sensor located "at" the outlet of gas cooler/condenser 2 may include a temperature sensor located close to the outlet of gas cooler/condenser 2, within gas cooler/condenser 2, along fluid conduit 3, at any location between gas cooler/condenser 2 and heat exchanger 61, at the refrigerant inlet 65 of heat exchanger 61, or any other location at which the $CO_2$ refrigerant can be expected to have the same or similar temperature as the $CO_2$ refrigerant at the outlet of gas cooler/condenser 2. Similarly, a temperature sensor located "at" the coolant inlet of heat exchanger 61 may be located along external coolant line 62, along a connecting line that connects external coolant line 62 to heat exchanger 61, within heat exchanger 61 near the coolant inlet, at any location within coolant subsystem 60 upstream of heat exchanger 61, at a fresh water intake for the building, or otherwise positioned to measure a temperature that is expected to be the same as or similar to the temperature of the external coolant flowing into heat exchanger 61.

When opened, the control valve 64*a* may not cause flow of the refrigerant to stop going through the bypass 67 of the fluid conduit 3, so the flow of refrigerant through the heat exchanger 61 may be reduced. The flow of refrigerant through the control valve 64*a* to the heat exchanger 61 can be increased by opening control valve 64*a* and closing control valve 64*b*. Alternatively, a three way control valve (not shown) can be placed at a first junction 69 or a second junction 70 to control a flow of the refrigerant to the heat exchanger 61, through the bypass 67, or a combination of both. The first junction 69 fluidly couples the refrigerant outlet 68 of the heat exchanger 61 to the fluid conduit 3. The second junction 70 fluidly couples the refrigerant inlet 65 to the fluid conduit 3. A three way control valve can direct flow of the refrigerant to the heat exchanger 61 as needed. For example, the three way control valve can control the flow of the refrigerant based on the temperature difference of the refrigerant and the external coolant. In an upstream configuration (at the second junction 70), the three way valve receives the refrigerant flow from the gas cooler/condenser 2 and directs the flow of refrigerant to the heat exchanger 61 or to the bypass 67 of the fluid conduit 3. This is a diverter three way valve configuration. In a downstream configuration (at the first junction 69) of the three way valve, the refrigerant flow from the heat exchanger 61 and refrigerant in the bypass 67 can both enter the three way valve and mix. The mixed flow exits the three way valve. This is a mixing valve configuration. Alternatively, two or more separate two way flow control valves (as shown) can be arranged to control the refrigerant flow in a similar fashion as a single three way valve.

When $CO_2$ refrigeration system 200 is configured to fluidly isolate the heat exchanger 61, the coolant subsystem 60 can be configured to remove the refrigerant. This can be referred to as a pump-out configuration. In the pump-out configuration, a pump conduit (not shown) with a pump-out control valve (not shown) are fluidly coupled to between the refrigerant inlet 65 and the refrigerant outlet 68 of the heat exchanger 61 and a lower pressure point in the $CO_2$ refrigeration system 200 like the fluid conduit 13. For example, the lower pressure point can be the MT compressors 14 suction header or the receiver 6 (a flash tank). The pump-out control valve in this pump conduit can be a solenoid valve which can be operated to open the pump-out conduit between the isolated heat exchanger 61 and the low pressure point in the system to "pump out" the $CO_2$ from the coil when it is not in use and isolated from the $CO_2$ refrigeration system 200.

The control valves can be operated in a sequence to allow flow from the gas cooler/condenser 2 to the high pressure control valve 4 (located just ahead of the receiver 6) which can reduce instances of backup or pressure drop between the two points of the system. For example, the control valve can open all control valves allowing parallel flow through both the heat exchanger 61 and the bypass 67 of the flow conduit 3 (the bypass conduit), and then shut off flow to one or both fluid flow paths through the heat exchanger 61.

Controller

Figure 3:
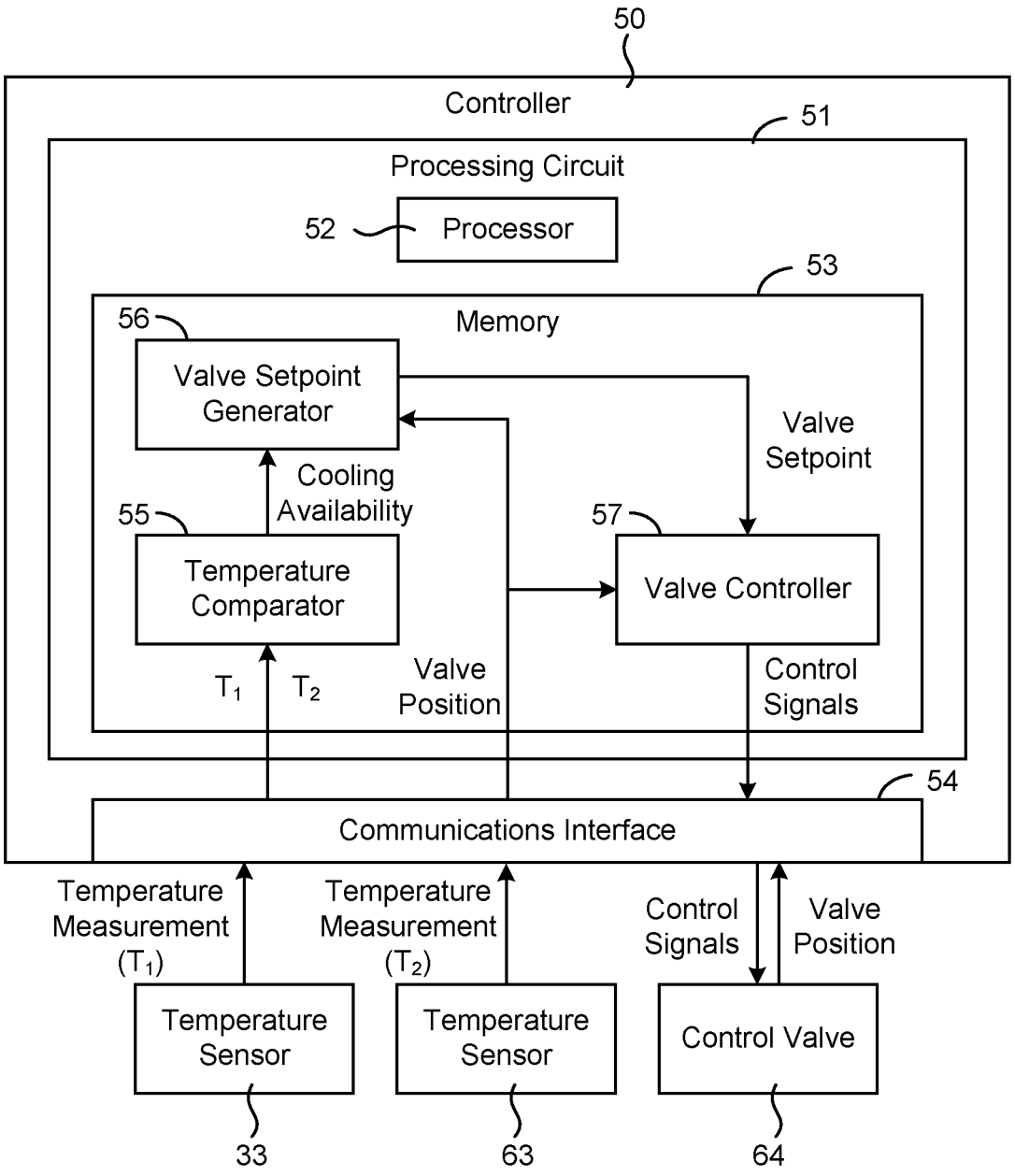
FIG. 3 is a block diagram of a controller configured to control the $CO_2$ refrigeration system of FIGS. 1 and 2A-2B, according to an exemplary embodiment.

Referring now to FIG. 3, a block diagram illustrating controller 50 in greater detail is shown, according to an exemplary embodiment. Controller 50 may receive signals from one or more measurement devices (e.g., pressure sensors, temperature sensors, flow sensors, etc.) or other devices of $CO_2$ refrigeration system 200. For example, controller 50 is shown receiving temperature measurements from temperature sensor 33 and temperature sensor 63. Controller 50 may also receive valve position signals from control valve 64 (as described in reference to FIG. 2A) or control valves 64*a* and 64*b* (as described in reference to FIG. 2B). Controller 50 may use the input signals to determine appropriate control actions for controllable devices of $CO_2$ refrigeration systems 200 of FIGS. 2A and 2B (e.g., compressors 14 and 24, parallel compressor 26, valves 4, 8, 11, and 21, control valve 64, 64*a*, and 64*b*, flow diverters, power supplies, etc.). For example, controller 50 is shown providing control signals control valve 64 of FIG. 2A and control valves 64*a* and 64*b* of FIG. 2B. The control signals provided to control valve 64 of FIGS. 2A and 64*a* and 64*b* of FIG. 2B may include valve position setpoints or operating commands.

Although controller 50 is only shown in FIG. 3 as communicating with a few of the components of $CO_2$ refrigeration systems 200, it should be understood that controller 50 may be configured to communicate with (e.g., monitor, control, collect data from, send data to, etc.) any or all of the components of $CO_2$ refrigeration systems 200 including, for example, compressors 14 and 24, parallel compressor 26, valves 4, 8, 11, and 21, control valves 64, 64*a*, and 64*b*, and/or any other controllable component of $CO_2$ refrigeration systems 200. Controller 50 may also receive measurements from any of a variety of sensors (e.g., temperature sensors, pressure sensors, flow sensors, etc.) located at any location within $CO_2$ refrigeration system 200 (e.g., located along any of fluid conduits 1, 3, 5, 7, 9, 13, 23, 27, and/or 42). Additionally, although controller 50 is described primarily with respect to $CO_2$ refrigeration systems 200, it should be understood that controller 50 may perform similar functions in $CO_2$ refrigeration system 100 for any of the components or devices that are shared between $CO_2$ refrigeration system 100 and $CO_2$ refrigeration systems 200.

Controller 50 can be configured to perform a variety of refrigerant control functions, coolant control functions, temperature control functions, pressure control functions, compressor control functions, valve control functions, superheat or subcooling control functions, or other functions to monitor and control $CO_2$ refrigeration systems 200. Several examples of additional functions which can be performed by controller 50 are described in detail in U.S. Pat. No. 8,631,666 granted Jan. 21, 2014, U.S. Pat. No. 9,689,590 granted Jun. 27, 2017, U.S. Pat. No. 9,470,435 granted Oct. 18, 2016, U.S. Pat. No. 9,377,236 granted Jun. 28, 2016, U.S. Patent Application Publication No. 2016/0102901 published Apr. 14, 2016, U.S. Pat. No. 10,502,461 granted Dec. 10, 2019, U.S. Pat. No. 10,663,201 granted May 26, 2020, U.S.

Patent Application Publication No. 2019/0376728 published Dec. 12, 2019, U.S. Patent Application Publication No. 2019/0368786 published Dec. 5, 2019, and U.S. Patent Application Publication No. 2020/0033039 published Jan. 30, 2020. The entire disclosures of each of these patents and patent application publications are incorporated by reference herein. Additionally, $CO_2$ refrigeration systems 200 and $CO_2$ refrigeration system 100 may include any combination or all of the components, devices, features, or functionality of the refrigeration systems described in the aforementioned patents and patent application publications in various embodiments.

Controller 50 may include feedback control functionality for adaptively operating the various components of $CO_2$ refrigeration systems 200. For example, controller 50 may receive a setpoint (e.g., a temperature setpoint, a pressure setpoint, a flow rate setpoint, a power usage setpoint, etc.) and operate one or more components of $CO_2$ refrigeration system 200 to achieve the setpoint. The setpoint may be specified by a user (e.g., via a user input device, a graphical user interface, a local interface, a remote interface, etc.) or automatically determined by controller 50 based on measurements from sensors of $CO_2$ refrigeration system 200, as described in greater detail below.

Controller 50 may be a proportional-integral (PI) controller, a proportional-integral-derivative (PID) controller, a pattern recognition adaptive controller (PRAC), a model recognition adaptive controller (MRAC), a model predictive controller (MPC), or any other type of controller employing any type of control functionality. In some embodiments, controller 50 is a local controller for $CO_2$ refrigeration systems 200. In other embodiments, controller 50 is a supervisory controller for a plurality of controlled subsystems (e.g., a refrigeration system, an AC system, a lighting system, a security system, etc.). For example, controller 50 may be a controller for a comprehensive building management system incorporating $CO_2$ refrigeration systems 200. Controller 50 may be implemented locally, remotely, or as part of a cloud-hosted suite of control applications.

Still referring to FIG. 3, controller 50 is shown to include a communications interface 54 and a processing circuit 51. Communications interface 54 can be or include wired or wireless interfaces (e.g., jacks, antennas, transmitters, receivers, transceivers, wire terminals, etc.) for conducting electronic data communications. For example, communications interface 54 may be used to conduct communications with gas bypass valve 8, parallel compressor 26, compressors 14 and 24, high pressure valve 4, control valve 64 of FIG. 2A. control valves 64*a* and 64*b* of FIG. 2B, various data acquisition devices within $CO_2$ refrigeration systems 200 (e.g., temperature sensors 33 and 63, pressure sensors, flow sensors, etc.) and/or other external devices or data sources. Data communications may be conducted via a direct connection (e.g., a wired connection, an ad-hoc wireless connection, etc.) or a network connection (e.g., an Internet connection, a LAN, WAN, or WLAN connection, etc.). For example, communications interface 54 can include an Ethernet card and port for sending and receiving data via an Ethernet-based communications link or network. In another example, communications interface 54 can include a Wi-Fi transceiver or a cellular or mobile phone transceiver for communicating via a wireless communications network.

Processing circuit 51 is shown to include a processor 52 and memory 53. Processor 52 can be implemented as a general purpose processor, an application specific integrated circuit (ASIC), one or more field programmable gate arrays (FPGAs), a group of processing components, a microcontroller, or other suitable electronic processing components. Memory 53 (e.g., memory device, memory unit, storage device, etc.) may be one or more devices (e.g., RAM, ROM, solid state memory, hard disk storage, etc.) for storing data and/or computer code for completing or facilitating the various processes, layers and modules described in the present application. Memory 53 may be or include volatile memory or non-volatile memory. Memory 53 may include database components, object code components, script components, or any other type of information structure for supporting the various activities and information structures described in the present application. According to an exemplary embodiment, memory 53 is communicably connected to processor 52 via processing circuit 51 and includes computer code for executing (e.g., by processing circuit 51 and/or processor 52) one or more processes or control features described herein.

Still referring to FIG. 3, controller 50 is shown to include a temperature comparator 55, a valve setpoint generator 56, and a valve controller 57. Temperature comparator 55 may receive a first temperature measurement $T_1$ of the $CO_2$ refrigerant at or near the refrigerant inlet of heat exchanger 61 from temperature sensor 33. Temperature comparator 55 may also receive a second temperature measurement $T_2$ of the external coolant at or near the coolant inlet of heat exchanger 61 from temperature sensor 63. Temperature comparator 55 may compare the two temperature measurements $T_1$ and $T_2$ to determine whether supplemental cooling is available from coolant subsystem 60. For example, if the temperature $T_1$ of the $CO_2$ refrigerant is less than or equal to the temperature $T_2$ of the external coolant (i.e., $T_1 \leq T_2$), temperature comparator 55 may determine that supplemental cooling from coolant subsystem 60 is not available. Conversely, if the temperature $T_1$ of the $CO_2$ refrigerant is greater than the temperature $T_2$ of the external coolant (i.e., $T_1 > T_2$), temperature comparator 55 may determine that supplemental cooling from coolant subsystem 60 is available. Temperature comparator 55 may generate and output a cooling availability determination (e.g., cooling available/unavailable, true/false, yes/no, etc.) to valve setpoint generator 56.

In some embodiments, temperature comparator 55 calculates a difference between the two temperature measurements $T_1$ and $T_2$. For example, temperature comparator 55 may subtract the temperature $T_2$ of the external coolant from the temperature $T_1$ of the $CO_2$ refrigerant to calculate a temperature difference $\Delta T$ (i.e., $\Delta T = T_1 - T_2$). The temperature difference $\Delta T$ may be positive when supplemental cooling is available and may be negative or zero when supplemental cooling is not available. In some embodiments, temperature comparator 55 provides the temperature difference $\Delta T$ to valve setpoint generator 56 along with the cooling availability determination.

Valve setpoint generator 56 may be configured to generate a valve setpoint for control valve 64 of FIG. 2A or control valves 64*a* and 64*b* of FIG. 2B based on the cooling availability determination and/or temperature difference $\Delta T$ from temperature comparator 55. In some embodiments, the valve setpoint is a position setpoint. For example, if the cooling availability determination from temperature comparator 55 indicates that supplemental cooling from coolant subsystem 60 is available, valve setpoint generator 56 may generate a valve position setpoint for control valve 64 of FIG. 2A or control valves 64*a* and 64*b* of FIG. 2B that causes the external coolant to flow through heat exchanger 61. Conversely, if the cooling availability determination from temperature comparator 55 indicates that supplemental cooling from coolant subsystem 60 is not available, valve setpoint generator 56 may generate a valve position setpoint for control valve 64 of FIG. 2A or control valves 64*a* and 64*b* of FIG. 2B that causes the external coolant to bypass heat exchanger 61.

Depending on the arrangement of control valve 64 of FIG. 2A or control valves 64*a* and 64*b* of FIG. 2B relative to heat exchanger 61, the valve position setpoint may cause control valve 64 of FIG. 2A or control valves 64*a* and 64*b* of FIG. 2B to open or close under the same set of conditions. For example, for embodiments in which control valve 64 is arranged in parallel with heat exchanger 61 as shown in FIG. 2A, valve setpoint generator 56 may generate a valve position setpoint that causes control valve 64 to close, thereby causing the external coolant to flow through heat exchanger 61, in response to receiving an indication that supplemental cooling is available from temperature comparator 55. In the parallel arrangement, valve setpoint generator 56 may generate a valve position setpoint that causes control valve 64 to open, thereby causing the external coolant to bypass heat exchanger 61, in response to receiving an indication that supplemental cooling is not available from temperature comparator 55.

In an alternative embodiment in which control valve 64 is arranged in series with heat exchanger 61, the valve position setpoints generated by valve setpoint generator 56 may be reversed relative to the parallel arrangement described above. For example, valve setpoint generator 56 may generate a valve position setpoint that causes control valve 64 to open, thereby causing the external coolant to flow through heat exchanger 61, in response to receiving an indication that supplemental cooling is available from temperature comparator 55. In the series arrangement, valve setpoint generator 56 may generate a valve position setpoint that causes control valve 64 to close, thereby preventing the external coolant from flowing through heat exchanger 61, in response to receiving an indication that supplemental cooling is not available from temperature comparator 55.

Depending on the arrangement of control valves 64*a* and 64*b* of FIG. 2B relative to heat exchanger 61, the valve position setpoint may cause control valves 64*a* and 64*b* of FIG. 2B to open or close under the same set of conditions. For example, for embodiments in which control valve 64*a* is arranged in series with heat exchanger 61 and control valve 64*b* is arranged in parallel with heat exchanger 61 as shown in FIG. 2B, valve setpoint generator 56 may generate a valve position setpoint that causes control valve 64*b* to close, thereby causing the refrigerant to flow through heat exchanger 61, in response to receiving an indication that supplemental cooling is available from temperature comparator 55. In the parallel arrangement, valve setpoint generator 56 may generate a valve position setpoint that causes control valve 64*b* to open, thereby causing the refrigerant to bypass heat exchanger 61, in response to receiving an indication that supplemental cooling is not available from temperature comparator 55.

In the alternative embodiment in which control valve 64*a* is arranged in series with heat exchanger 61, the valve position setpoints generated by valve setpoint generator 56 may be reversed relative to the parallel arrangement described above. For example, valve setpoint generator 56 may generate a valve position setpoint that causes control valve 64*a* to open, thereby causing the refrigerant to flow through heat exchanger 61, in response to receiving an indication that supplemental cooling is available from temperature comparator 55. In the series arrangement, valve setpoint generator 56 may generate a valve position setpoint that causes control valve 64*a* to close, thereby preventing the refrigerant from flowing through heat exchanger 61, in response to receiving an indication that supplemental cooling is not available from temperature comparator 55.

In some embodiments, the valve position setpoints may be absolute position values (e.g., fully closed, fully open, 20% open, 40% open, 60% open, 80% open, etc.) or relative position values (e.g., close by 20%, close by 40%, open or close by 30 degrees, open or close by 60 degrees, etc.). Absolute position values may cause control valve 64 to move into the specified valve position, whereas relative position values may cause control valve 64 to move toward either the fully closed position or the fully open position by the specified amount. In some embodiments, valve setpoint generator 56 generates the valve setpoint based on both the cooling availability determination from temperature comparator 55 and the current valve position of control valve 64. In this scenario, valve setpoint generator 56 may add the desired valve control action (e.g., open by 20% more, close by 30% more, etc.) to the current position of control valves 64 of FIG. 2A or control valves 64*a* and 64*b* of FIG. 2B to determine the absolute position setpoint. For example, if the current position of control valve 64 is 50% open and the desired control action is to open control valve 64 by 20% more, valve setpoint generator 56 may add 50% to 20% to determine that the position setpoint for control valve 64 of FIG. 2A or control valves 64*a* and 64*b* of FIG. 2B should be 70% open.

In some embodiments, the valve setpoint is a command to open or close control valve 64 of FIG. 2A or control valves 64*a* and 64*b* of FIG. 2B. Such commands may be the same as or similar to setpoints that cause control valve 64 to move into a fully open position, a fully closed position, or an intermediate position between fully open and fully closed. Accordingly, a command to open or close control valve 64 of FIG. 2A or control valves 64*a* and 64*b* of FIG. 2B (either fully or by a specified amount) may be interpreted as being equivalent to a valve position command for purposes of the present disclosure.

In some embodiments, valve setpoint generator 56 generates the valve setpoint as a function of the temperature difference $\Delta T$. For example, valve setpoint generator 56 may use a stored relationship, mapping, or function between the temperature difference $\Delta T$ and corresponding valve positions to generate the valve setpoint. In some embodiments, relatively larger values of the temperature difference $\Delta T$ cause valve setpoint generator 56 to generate more aggressive valve setpoints (e.g., fully open, fully closed, etc.), whereas relatively smaller values of the temperature difference $\Delta T$ cause valve setpoint generator 56 to generate less aggressive valve setpoints (e.g., 20% open, 20% closed, etc.). The valve setpoints generated by valve setpoint generator 56 may be provided as an input to valve controller 57.

Valve controller 57 may be a feedback controller configured to operate control valve 64 of FIG. 2A or control valves 64*a* and 64*b* of FIG. 2B to achieve the valve setpoint. In some embodiments, valve controller 57 receives the valve setpoint from valve setpoint generator 56 and receives an indication of the valve position from control valve 64 or a measurement device configured to monitor the position of control valve 64. Valve controller 57 may generate control signals that cause control valve 64 of FIG. 2A or control valves 64*a* and 64*b* of FIG. 2B to move into or toward the valve setpoint. Valve controller 57 may use any of a variety of feedback control techniques to drive the valve position toward the valve setpoint including, for example, proportional-integral (PI) control, proportional-integral-derivative (PID) control, pattern recognition adaptive control (PRAC), a model recognition adaptive control (MRAC), model predictive control (MPC), or any other type of feedback control functionality.

In some embodiments, regardless of how the valve setpoints or control signals are generated, controller 50 may operate control valve 64 of FIG. 2A or control valves 64*a* and 64*b* of FIG. 2B to cause the external coolant to flow through heat exchanger 61 when the temperature $T_1$ of the $CO_2$ refrigerant exceeds the temperature $T_2$ of the external coolant, thereby providing supplemental cooling for the $CO_2$ refrigerant by transferring heat from the $CO_2$ refrigerant to the external coolant within heat exchanger 61. Conversely, controller 50 may operate control valve 64 of FIG. 2A or control valves 64*a* and 64*b* of FIG. 2B to prevent the external coolant from flowing through heat exchanger 61 when the temperature $T_1$ of the $CO_2$ refrigerant is greater than or equal to the temperature $T_2$ of the external coolant, thereby preventing heat exchange from occurring between the $CO_2$ refrigerant and the external coolant.

Control Processes

Figure 4:
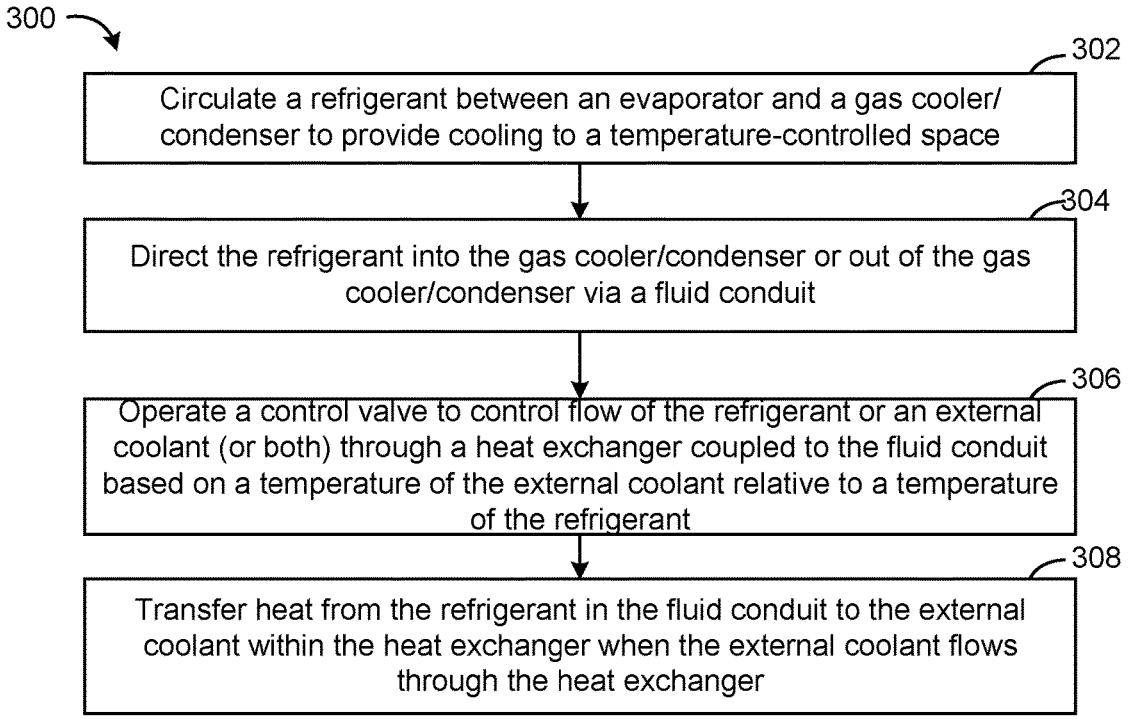
FIG. 4 is a flowchart of a process which can be performed by the controller of FIG. 3 to operate the $CO_2$ refrigeration system of FIGS. 1 and 2A-2B, according to an exemplary embodiment.

Referring now to FIG. 4, a flowchart of a process 300 for operating $CO_2$ refrigeration system 200 is shown, according to an exemplary embodiment. Process 300 can be performed by controller 50 to provide supplemental cooling to the $CO_2$ refrigerant when the temperature of the $CO_2$ refrigerant flowing through heat exchanger 61 exceeds the temperature of the external coolant provided by coolant subsystem 60.

Process 300 is shown to include circulating a refrigerant between an evaporator and a gas cooler/condenser to provide cooling to a temperature-controlled space (step 302). The evaporator may include one or more of MT evaporators 12 and/or LT evaporators 22, whereas the gas cooler/condenser may include gas cooler/condenser 2, as described with reference to FIGS. 1-3. Circulating the refrigerant may include operating one or more compressors of $CO_2$ refrigeration system 200 (e.g., MT compressors 14, LT compressors 24, parallel compressor 26, high pressure valve 4, gas bypass valve 8, expansion valves 11, expansion valves 21, etc.) to cause the refrigerant to circulate between evaporators 12, 22 and gas cooler/condenser 2. The refrigerant may absorb heat in evaporators 12, 22 and reject heat in gas cooler/condenser 2 as part of a vapor-compression refrigeration cycle. Evaporators 12, 22 may be located within a temperature-controlled space or within an airstream that is provided to the temperature-controlled space such that evaporators 12, 22 absorb heat from the temperature-controlled space or the airflow. For example, evaporators 12, 22 may be part of a refrigerator, freezer, refrigerated display case, air conditioning unit, or other heat exchanger configured to absorb heat from the temperature-controlled space and transfer the heat into the refrigerant circulating through evaporators 12, 22. After absorbing heat in evaporators 12, 22, the refrigerant may be circulated through one or more components of $CO_2$ refrigeration system 200 to gas cooler/condenser 2 where the refrigerant rejects heat.

Process 300 is shown to include directing the refrigerant into the gas cooler/condenser or out of the gas cooler/condenser via a fluid conduit (step 304). For embodiments in which heat exchanger 61 is located upstream of gas cooler/condenser 2 (e.g., along fluid conduit 1), the fluid conduit in step 304 may be fluid conduit 1 connecting discharge line 42 to gas cooler/condenser 2 and directing the refrigerant in step 304 may include directing the refrigerant from heat exchanger 61 to the inlet of gas cooler/condenser 2. For embodiments in which heat exchanger 61 is located downstream of gas cooler/condenser 2 (as shown in FIGS. 2A and 2B), the fluid conduit in step 304 may be fluid conduit 3 connecting gas cooler/condenser 2 to high pressure valve 4 and directing the refrigerant may include directing the refrigerant from the outlet of gas cooler/condenser 2 through heat exchanger 61 via fluid conduit 3. Alternatively, for embodiments in which heat exchanger 61 is located downstream of high pressure valve 4, the fluid conduit in step 304 may be fluid conduit 5 connecting high pressure valve 4 to receiver 6. In various embodiments, the fluid conduit in step 304 may be directly attached to gas cooler/condenser 2 (e.g., fluid conduits 1 or 3) or fluidly coupled to gas cooler/condenser 2 via one or more intermediate components (e.g., fluid conduit 5 coupled to gas cooler/condenser 2 via high pressure valve 4 and fluid conduit 3) that operate to direct the flow of the refrigerant between gas cooler/condenser 2 and heat exchanger 61.

Process 300 is shown to include operating a control valve to control flow of a refrigerant or an external coolant through a heat exchanger coupled to the fluid conduit based on a temperature of the external coolant relative to a temperature of the refrigerant (step 306). In some embodiments, the control valve in step 306 is control valve 64 of FIG. 2A or control valves 64*a* and 64*b* of FIG. 2B and the heat exchanger in step 306 is heat exchanger 61, as described with reference to FIGS. 2A-3. In some embodiments, the control valve in step 306 is control valve 64 and the heat exchanger in step 306 is heat exchanger 61, as described with reference to FIGS. 2B-3. Heat exchanger 61 may be fluidly coupled to both the fluid conduit in step 306 and an external coolant line 62 (e.g., located along external coolant line 62, connected to external coolant line 62 via connecting lines, etc.). Heat exchanger 61 may receive the external coolant (e.g., airflow, water, glycol, etc.) at a coolant inlet of heat exchanger 61 and may receive the refrigerant at a refrigerant inlet 65 of heat exchanger 61. Both the external coolant and the $CO_2$ refrigerant may flow through heat exchanger 61 to allow for heat transfer therebetween. In operation, heat exchanger 61 may transfer heat from the $CO_2$ refrigerant to the external coolant flowing through heat exchanger 61, thereby providing additional cooling for the $CO_2$ refrigerant. Advantageously, the additional cooling provided by heat exchanger 61 may improve (i.e., increase) the overall efficiency of $CO_2$ refrigeration system 200 relative to $CO_2$ refrigeration system 100.

The external coolant in step 306 may be received at heat exchanger 61 from any of a variety of external coolant sources. In some embodiments, external coolant line 62 is a building water supply line that receives water from a city or municipal water supply. The water supplied via external coolant line 62 may be the same as the water used for other purposes within the building (e.g., sinks, food preparation, bathroom fixtures, drinking fountains, fire suppression, etc.). For example, the same plumbing system that provides water to sinks, drinking fountains, bathroom fixtures, and other locations at which water is used within the building may be connected to external coolant line 62 to provide water to heat exchanger 61.

In some embodiments, external coolant line 62 is a water supply line that receives water from a different water source such as reclaimed rain water or a chilled water system. In a chilled water system, one or more chillers may be coupled to external coolant line 62 and may operate to provide cooling to the water flowing through external coolant line 62. In other embodiments, external coolant line 62 is a glycol supply line that provides a flow of glycol through heat exchanger 61. In various embodiments, the external coolant may be water (e.g., city/municipal water, rain water, etc.), glycol, or any of a variety of other coolants (e.g., airflow, cutting fluid, mineral oils, polyphenyl ether oils, silicone oils, etc.). The external coolant may flow through external coolant line 62 as a result of pressure provided by an external source (e.g., a pressurized water line from a city or municipality, a water tower, etc.) and/or a fluid pump or fan located along external coolant line 62 and configured to pump or circulate the external coolant through external coolant line 62. In some embodiments, a fluid pump or fan may be included in coolant subsystem 60 (e.g., located along external coolant line 62) to cause the external coolant to circulate through external coolant line 62.

The temperature of the refrigerant in step 306 may be measured by temperature sensor 33, whereas the temperature of the external coolant in step 306 may be measured by temperature sensor 63. Temperature sensors 33 and 63 may be positioned to measure the temperature of the $CO_2$ refrigerant and the external coolant at or near heat exchanger 61. In some embodiments, temperature sensors 33 and 63 may be located upstream of heat exchanger 61 (e.g., along fluid conduit 3 and external coolant line 62, respectively, as shown in FIG. 2) such that the temperature measurements of the $CO_2$ refrigerant and the external coolant from temperature sensors 33 and 63 reflect the temperatures of the fluids flowing into heat exchanger 61. In some embodiments, temperature sensor 33 may be located at an outlet of gas cooler/condenser 2 (e.g., along fluid conduit 3, between gas cooler/condenser 2 and heat exchanger 61, at a refrigerant inlet of heat exchanger 61) such that temperature sensor 33 measures the temperature of the $CO_2$ refrigerant exiting gas cooler/condenser 2 and entering heat exchanger 61. For embodiments in which heat exchanger 61 is located upstream of gas cooler/condenser 2 (e.g., along fluid conduit 1), temperature sensor 33 may be located at an outlet of MT compressors 14 (e.g., along discharge line 42, between MT compressors 14 and heat exchanger 61, at a refrigerant inlet of heat exchanger 61) such that temperature sensor 33 measures the temperature of the $CO_2$ refrigerant exiting MT compressors 14 and entering heat exchanger 61. Temperature sensor 63 may be located along external coolant line 62, along a connecting line that connects external coolant line 62 to heat exchanger 61, at a coolant inlet of heat exchanger 61, or otherwise positioned to measure the temperature of the external coolant flowing into heat exchanger 61.

In step 306, controller 50 may receive temperature measurements of the external coolant from temperature sensor 63 as well as temperature measurements of the $CO_2$ refrigerant from temperature sensor 33. Controller 50 may operate control valve 64 of FIG. 2A or control valves 64*a* and 64*b* of FIG. 2B to cause at least one of the refrigerant or the external coolant to flow through heat exchanger 61 when the temperature $T_1$ of the $CO_2$ refrigerant exceeds the temperature $T_2$ of the external coolant, thereby providing supplemental cooling for the $CO_2$ refrigerant by transferring heat from the $CO_2$ refrigerant to the external coolant within heat exchanger 61. Conversely, controller 50 may operate control valve 64 of FIG. 2A or control valves 64*a* and 64*b* of FIG. 2B to prevent the external coolant from flowing through heat exchanger 61 when the temperature $T_1$ of the $CO_2$ refrigerant is greater than or equal to the temperature $T_2$ of the external coolant, thereby preventing heat exchange from occurring between the $CO_2$ refrigerant and the external coolant.

Step 306 may include operating control valve 64 of FIG. 2A or control valves 64*a* and 64*b* of FIG. 2B to control the flow rate of at least one of the refrigerant or the external coolant through heat exchanger 61. In various embodiments, control valve 64 may be located along external coolant line 62 or along a connecting line that connects external coolant line 62 to heat exchanger 61. In the embodiment shown in FIG. 2A, control valve 64 is located along external coolant line 62 and arranged in parallel with heat exchanger 61. Accordingly, control valve 64 can be opened to allow the external coolant to bypass heat exchanger 61 or closed to cause the external coolant to flow through heat exchanger 61. For embodiments in which control valve 64 is located along one of the connecting lines (e.g., in series with heat exchanger 61), control valve can be closed to prevent the external coolant from flowing through heat exchanger 61 or opened to allow the external coolant to flow through heat exchanger 61. In these or other suitable positions of control valve 64, the position of control valve 64 can be controlled to modulate or control the flow rate of the external coolant through heat exchanger 61. The position of control valve 64 may be set to any of a variety of positions including fully open (e.g., 100% open), fully closed (e.g., 0% open), and/or any intermediate position between fully open and fully closed (e.g., 20% open, 40% open, 60% open, 80% open, etc.).

In various embodiments, control valves 64*a* and 64*b* may be located along fluid conduit 3 to heat exchanger 61. In the embodiment shown in FIG. 2B, control valve 64*b* is located along the bypass 67 of fluid conduit 3 and arranged in parallel with heat exchanger 61. Accordingly, control valve 64*b* can be opened to allow the refrigerant to bypass heat exchanger 61 or closed to cause the refrigerant to flow through heat exchanger 61. For embodiments in which control valve 64*a* is located along the fluid conduit 3 in series with the heat exchanger 61, control valve 64*a* can be closed to prevent the refrigerant from flowing through heat exchanger 61 or opened to allow the refrigerant to flow through heat exchanger 61. In these or other suitable positions of control valves 64*a* and 64*b*, the position of control valves 64*a* and 64*b* can be controlled to modulate or control the flow rate of the refrigerant through heat exchanger 61. The position of control valves 64*a* and 64*b* may be set to any of a variety of positions including fully open (e.g., 100% open), fully closed (e.g., 0% open), and/or any intermediate position between fully open and fully closed (e.g., 20% open, 40% open, 60% open, 80% open, etc.).

In some embodiments, the position of control valve 64 or control valves 64*a* and 64*b* is automatically controlled by a controller 50. For example, controller 50 may provide control signals to control valve 64 or control valves 64*a* and 64*b* to an actuator which operates to adjust the position of control valve 64 or control valves 64*a* and 64*b* to cause control valve 64 or control valves 64*a* and 64*b* to move into a desired position (i.e., a position setpoint). The position setpoint for control valve 64 or control valves 64*a* and 64*b* may be automatically determined by controller 50 based on the temperatures of the external coolant and the $CO_2$ refrigerant, as described in detail with reference to FIG. 3.

Process 300 is shown to include transferring heat from the refrigerant in the fluid conduit to the external coolant within the heat exchanger when the external coolant flows through the heat exchanger (step 308). In some embodiments, step 308 occurs as a result of the temperature difference between the $CO_2$ refrigerant and the external coolant flowing through heat exchanger 61. For example, water received from a city or municipal water supply typically has a temperature of approximately 55° F.-75° F., which may be significantly colder than the temperature of the $CO_2$ refrigerant exiting gas cooler/condenser 2, which may be approximately 95° F. or higher during summer months. The temperature difference between the $CO_2$ refrigerant exiting gas cooler/condenser 2 and the temperature of the water supply provides an opportunity to cool the $CO_2$ refrigerant in heat exchanger 61 without running additional chillers or consuming a significant amount of additional energy.

In some embodiments, the heat transferred from the $CO_2$ refrigerant to the external coolant in step 308 may be used for other purposes inside the building. For example, the heated coolant exiting heat exchanger 61 may be delivered to a heater, air handling unit, damper, air duct, or otherwise exposed to airflow for the building to transfer heat from the heated coolant to the airflow. Other uses for the heated coolant may include circulating the heated coolant through a radiative heating system (e.g., a set of radiators), circulating the heated coolant through a heated flooring system, using the heated coolant to pre-heat water for a boiler or water heater for the building, or otherwise reclaiming the heat from the heated coolant.

Figure 5:
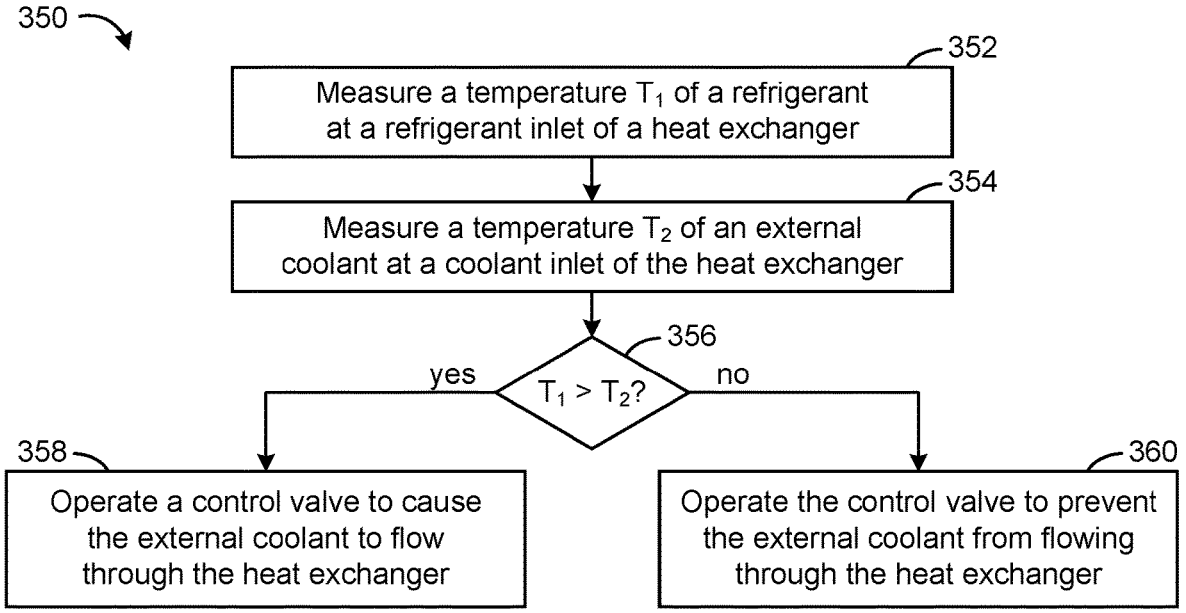
FIG. 5 is a flowchart of a process which can be performed by the controller of FIG. 3 to operate a control valve in the $CO_2$ refrigeration system of FIGS. 1 and 2A-2B, according to an exemplary embodiment.

Referring now to FIG. 5, a flowchart of a process 350 for operating control valve 64 is shown, according to an exemplary embodiment. Process 350 can be performed by controller 50 to modulate the flow of the external coolant through heat exchanger 61.

Process 350 is shown to include measuring a temperature $T_1$ of a refrigerant at a refrigerant inlet of a heat exchanger (step 352) and measuring a temperature $T_2$ of an external coolant at a coolant inlet of the heat exchanger (step 354). The heat exchanger in steps 352-354 may be heat exchanger 61 and may be located at a variety of different positions within $CO_2$ refrigeration system 200 (e.g. along fluid conduit 1, along fluid conduit 3, along fluid conduit 5, etc.), as described with reference to FIGS. 2-3. The temperature of the refrigerant in step 352 may be measured by temperature sensor 33, whereas the temperature of the external coolant in step 354 may be measured by temperature sensor 63. Temperature sensors 33 and 63 may be positioned to measure the temperature of the $CO_2$ refrigerant and the external coolant at or near heat exchanger 61.

In some embodiments, temperature sensors 33 and 63 may be located upstream of heat exchanger 61 (e.g., along fluid conduit 3 and external coolant line 62, respectively, as shown in FIG. 2) such that the temperature measurements of the $CO_2$ refrigerant and the external coolant from temperature sensors 33 and 63 reflect the temperatures of the fluids flowing into heat exchanger 61. In some embodiments, temperature sensor 33 may be located at an outlet of gas cooler/condenser 2 (e.g., along fluid conduit 3, between gas cooler/condenser 2 and heat exchanger 61, at a refrigerant inlet of heat exchanger 61) such that temperature sensor 33 measures the temperature of the $CO_2$ refrigerant exiting gas cooler/condenser 2 and entering heat exchanger 61. For embodiments in which heat exchanger 61 is located upstream of gas cooler/condenser 2 (e.g., along fluid conduit 1), temperature sensor 33 may be located at an outlet of MT compressors 14 (e.g., along discharge line 42, between MT compressors 14 and heat exchanger 61, at a refrigerant inlet of heat exchanger 61) such that temperature sensor 33 measures the temperature of the $CO_2$ refrigerant exiting MT compressors 14 and entering heat exchanger 61. Temperature sensor 63 may be located along external coolant line 62, along a connecting line that connects external coolant line 62 to heat exchanger 61, at a coolant inlet of heat exchanger 61, or otherwise positioned to measure the temperature of the external coolant flowing into heat exchanger 61.

Process 350 is shown to include determining whether the temperature of the refrigerant $T_1$ at the refrigerant at a refrigerant inlet of heat exchanger 61 exceeds the temperature $T_2$ of the external coolant at the coolant inlet of heat exchanger 61 (step 356). In some embodiments, step 356 may be performed by controller 50, specifically temperature comparator 55, as described with reference to FIG. 3. Step 356 may include comparing the two temperature measurements $T_1$ and $T_2$ to determine whether supplemental cooling is available from coolant subsystem 60. For example, if the temperature $T_1$ of the $CO_2$ refrigerant is less than or equal to the temperature $T_2$ of the external coolant (i.e., $T_1 \leq T_2$), step 356 may include determining that supplemental cooling from coolant subsystem 60 is not available. Conversely, if the temperature $T_1$ of the $CO_2$ refrigerant is greater than the temperature $T_2$ of the external coolant (i.e., $T_1 > T_2$), step 356 may include determining that supplemental cooling from coolant subsystem 60 is available In some embodiments, step 356 includes calculating a difference between the two temperature measurements $T_1$ and $T_2$. For example, step 356 may include subtracting the temperature $T_2$ of the external coolant from the temperature $T_1$ of the $CO_2$ refrigerant to calculate a temperature difference $\Delta T$ (i.e., $\Delta T = T_1 - T_2$). The temperature difference $\Delta T$ may be positive when supplemental cooling is available and may be negative or zero when supplemental cooling is not available. In some embodiments, step 356 includes generating and providing a cooling availability determination and/or the temperature difference $\Delta T$ to valve setpoint generator 56.

Process 350 is shown to include operating a control valve to cause the external coolant to flow through the heat exchanger (step 358). Step 358 may be performed in response to a determination in step 356 that the temperature of the refrigerant $T_1$ at the refrigerant at the refrigerant inlet of heat exchanger 61 exceeds the temperature $T_2$ of the external coolant at the coolant inlet of heat exchanger 61 (i.e., $T_1 > T_2$). The control valve operated in step 358 may be control valve 64 or control valves 64*a* and 64*b*, as described with reference to FIGS. 2-4.

Depending on the arrangement of control valve 64 relative to heat exchanger 61, operating the control valve in step 358 may cause control valve 64 to open or close to cause at least one of the refrigerant or the external coolant to flow through heat exchanger 61. For example, for embodiments in which control valve 64 or control valves 64*a* and 64*b* are arranged in parallel with heat exchanger 61 as shown in FIG. 2A or FIG. 2B, respectively, the control action performed in step 358 may cause control valve 64 or control valves 64*a* and 64*b* to close, thereby causing at least one of the refrigerant or the external coolant to flow through heat exchanger 61. For embodiments in which control valve 64 or control valves 64*a* and 64*b* is arranged in series with heat exchanger 61, the control action performed in step 358 may be reversed relative to the parallel arrangement. For example, the control action performed in step 358 may cause control valve 64 or control valves 64*a* and 64*b* to open, thereby causing the external coolant to flow through heat exchanger 61, when control valve 64 or control valves 64*a* and 64*b* is arranged in series with heat exchanger 61

Process 350 is shown to include operating a control valve to prevent the external coolant from flowing flow through the heat exchanger (step 360). Step 360 may be performed in response to a determination in step 356 that the temperature of the refrigerant $T_1$ at the refrigerant at a refrigerant inlet of heat exchanger 61 does not exceed the temperature $T_2$ of the external coolant at the coolant inlet of heat exchanger 61 (i.e., $T_1$; $T_2$). The control valve operated in step 360 may be control valve 64 or control valves 64*a* and 64*b*, as described with reference to FIGS. 2A and 2B through 4.

Depending on the arrangement of control valve 64 or control valves 64*a* and 64*b* relative to heat exchanger 61, operating the control valve in step 360 may cause control valve 64 or control valves 64*a* and 64*b* to open or close to prevent at least one of the refrigerant or the external coolant from flowing through heat exchanger 61. For example, for embodiments in which control valve 64 or control valves 64*a* and 64*b* is arranged in parallel with heat exchanger 61 as shown in FIG. 2, the control action performed in step 360 may cause control valve 64 or control valves 64*a* and 64*b* to open, thereby causing at least one of the refrigerant or the external coolant to bypass heat exchanger 61. For embodiments in which control valve 64 or control valves 64*a* and 64*b* is arranged in series with heat exchanger 61, the control action performed in step 360 may be reversed relative to the parallel arrangement. For example, the control action performed in step 360 may cause control valve 64 or control valves 64*a* and 64*b* to close, thereby preventing the external coolant from flowing through heat exchanger 61, in the series arrangement.

In some embodiments, operating control valve 64 in steps 358-360 includes generating valve position setpoints for control valve 64 or control valves 64*a* and 64*b*, as described with reference to valve setpoint generator 56. The valve position setpoints may be absolute position values (e.g., fully closed, fully open, 20% open, 40% open, 60% open, 80% open, etc.) or relative position values (e.g., close by 20%, close by 40%, open or close by 30 degrees, open or close by 60 degrees, etc.). Absolute position values may cause control valve 64 or control valves 64*a* and 64*b* to move into the specified valve position, whereas relative position values may cause control valve 64 or control valves 64*a* and 64*b* to move toward either the fully closed position or the fully open position by the specified amount. In some embodiments, steps 358-360 include generating the valve setpoint based on both the cooling availability determination from step 356 and the current valve position of control valve 64 or control valves 64*a* and 64*b*. In this scenario, steps 358-360 may include adding the desired valve control action (e.g., open by 20% more, close by 30% more, etc.) to the current position of control valve 64 to determine the absolute position setpoint. For example, if the current position of control valve 64 or control valves 64*a* and 64*b* are 50% open and the desired control action is to open control valve 64 or control valves 64*a* and 64*b* by 20% more, step 358 may include adding 50% to 20% to determine that the position setpoint for control valve 64 or control valves 64*a* and 64*b* should be 70% open.

In some embodiments, the valve setpoint generated in steps 358-360 is a command to open or close control valve 64 or control valves 64*a* and 64*b*. Such commands may be the same as or similar to setpoints that cause control valve 64 to move into a fully open position, a fully closed position, or an intermediate position between fully open and fully closed. Accordingly, a command to open or close control valve 64 or control valves 64*a* and 64*b* (either fully or by a specified amount) may be interpreted as being equivalent to a valve position command for purposes of the present disclosure.

In some embodiments, steps 358-360 include generating the valve setpoint as a function of the temperature difference ΔT. For example, steps 358-360 may include using a stored relationship, mapping, or function between the temperature difference ΔT and corresponding valve positions to generate the valve setpoint. In some embodiments, relatively larger values of the temperature difference ΔT cause more aggressive valve setpoints (e.g., fully open, fully closed, etc.) to be generated in steps 358-360, whereas relatively smaller values of the temperature difference ΔT cause less aggressive valve setpoints (e.g., 20% open, 20% closed, etc.) to be generated in steps 358-360. The valve setpoints generated in steps 358-360 may be provided as an input to a feedback control process, such as the feedback control process performed by valve controller 57 as described with reference to FIG. 3.

In some embodiments, steps 358-360 include using a feedback control process to operate control valve 64 or control valves 64*a* and 64*b* to achieve the valve setpoint. In some embodiments, steps 358-360 include receiving the valve setpoint from and an indication of the valve position from control valve 64 or control valves 64*a* and 64*b* or a measurement device configured to monitor the position of control valve 64 or control valves 64*a* and 64*b*. Steps 358-360 may include generating control signals that cause control valve 64 to move into or toward the valve setpoint. Steps 358-360 may include using any of a variety of feedback control techniques to drive the valve position toward the valve setpoint including, for example, proportional-integral (PI) control, proportional-integral-derivative (PID) control, pattern recognition adaptive control (PRAC), a model recognition adaptive control (MRAC), model predictive control (MPC), or any other type of feedback control functionality.

In some embodiments, regardless of how the valve setpoints or control signals are generated, steps 358-360 may include operating control valve 64 or control valves 64*a* and 64*b* to cause the external coolant to flow through heat exchanger 61 when the temperature $T_1$ of the $CO_2$ refrigerant exceeds the temperature $T_2$ of the external coolant, thereby providing supplemental cooling for the $CO_2$ refrigerant by transferring heat from the $CO_2$ refrigerant to the external coolant within heat exchanger 61. Conversely, 358-360 may include operating control valve 64 or control valves 64*a* and 64*b* to prevent the external coolant from flowing through heat exchanger 61 when the temperature $T_1$ of the $CO_2$ refrigerant is greater than or equal to the temperature $T_2$ of the external coolant, thereby preventing heat exchange from occurring between the $CO_2$ refrigerant and the external coolant.

CONFIGURATION OF EXEMPLARY EMBODIMENTS

The construction and arrangement of the $CO_2$ refrigeration system as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

It is contemplated that any of the components, functionality, method steps, details or other features described herein can be combined into a single embodiment, included in any of the embodiments of the present disclosure, or selectively excluded from any of the embodiments of the present disclosure without departing from the scope of the present invention. Any references to "some embodiments," "one embodiment," "exemplary embodiment," "various embodiments," and the like throughout the present disclosure may be referring to the same embodiment or different embodiments. The terms "may," "can," "could," "might," or similar terms are used throughout the present disclosure to describe features that are optional and should be understood as having the same or similar meaning as "in some embodiments." The terms "cases," "implementations," and the like should be understood as having the same or similar meaning as "embodiments." Additionally, it is contemplated that any features described in the summary section and/or recited in the claims can be combined into the same embodiment, even if such features are recited in separate dependent claims that do not refer to each other in the claim set.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The present disclosure contemplates methods, systems and program products on memory or other machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products or memory including machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A refrigeration system comprising:

a refrigeration subsystem configured to circulate a refrigerant between an evaporator within which a refrigerant absorbs heat and a gas cooler/condenser within which the refrigerant rejects heat to provide cooling to a temperature-controlled space;

a coolant subsystem comprising:

a heat exchanger coupled to the refrigeration subsystem at an outlet of the gas cooler/condenser and configured to transfer heat from the refrigerant exiting the gas cooler/condenser to an external coolant when the external coolant flows through the heat exchanger, the external coolant circulated from a source external to the refrigeration system and circulated back to the source external to the refrigeration system after flowing through the heat exchanger, the source external to the refrigeration system comprising a building liquid supply; and a control valve fluidly coupled to the heat exchanger; and a controller configured to operate the control valve to control a flow of at least one of the refrigerant or the external coolant through the heat exchanger based on a temperature of the external coolant relative to a temperature of the refrigerant exiting the gas cooler/condenser.

2. The refrigeration system of claim 1, further comprising:

a refrigerant temperature sensor located at the outlet of the gas cooler/condenser and configured to measure the temperature of the refrigerant exiting the gas cooler/condenser; and an external coolant temperature sensor located at a coolant inlet of the heat exchanger and configured to measure the temperature of the external coolant at the coolant inlet of the heat exchanger.

3. The refrigeration system of claim 1, wherein the controller is configured to:

operate the control valve to increase the flow of at least one of the refrigerant or the external coolant through the heat exchanger in response to a determination that the temperature of the external coolant is less than the temperature of the refrigerant within a fluid conduit between the evaporator and the gas cooler/condenser; and operate the control valve to decrease the flow of at least one of the refrigerant or the external coolant through the heat exchanger in response to a determination that the temperature of the external coolant is greater than or equal to than the temperature of the refrigerant within the fluid conduit.

4. The refrigeration system of claim 1, wherein:

the coolant subsystem comprises an external coolant line configured to deliver the external coolant to the heat exchanger; and the control valve is located along the external coolant line in parallel with the heat exchanger such that closing the control valve causes the external coolant to flow through the heat exchanger and opening the control valve causes the external coolant to bypass the heat exchanger.

5. The refrigeration system of claim 1, wherein the controller is configured to:

determine whether supplemental cooling of the refrigerant is available by comparing the temperature of the external coolant to the temperature of the refrigerant exiting the gas cooler/condenser;

generate a valve setpoint for the control valve based on whether the supplemental cooling is available; and operate the control valve to achieve the valve setpoint.

6. The refrigeration system of claim 1, wherein the external coolant comprises at least one of:

water received from a city or municipal water supply for the building in which the refrigeration system is installed; or rain water collected from rainfall at the building in which the refrigeration system is installed.

7. A refrigeration system comprising:

an evaporator within which a refrigerant absorbs heat;

a gas cooler/condenser within which the refrigerant rejects heat;

a fluid conduit attached to an inlet of the gas cooler/condenser or an outlet of the gas cooler/condenser to direct the refrigerant into the gas cooler/condenser or out of the gas cooler/condenser;

a heat exchanger coupled to the fluid conduit and within which heat is transferred from the refrigerant in the fluid conduit to an external coolant when the external coolant flows through the heat exchanger, the external coolant circulated from a source external to the refrigeration system and circulated back to the source external to the refrigeration system after flowing through the heat exchanger, the source external to the refrigeration system comprising a building water supply line;

a control valve fluidly coupled to the heat exchanger; and a controller configured to operate the control valve to control a flow of at least one of the refrigerant or the external coolant through the heat exchanger based on a temperature of the external coolant relative to a temperature of the refrigerant within the fluid conduit.

8. The refrigeration system of claim 7, wherein the fluid conduit is coupled to the outlet of the gas cooler/condenser and configured to direct the refrigerant out of the gas cooler/condenser through the heat exchanger.

9. The refrigeration system of claim 7, wherein the fluid conduit is coupled to the inlet of the gas cooler/condenser and configured to direct the refrigerant from the heat exchanger through the gas cooler/condenser.

10. The refrigeration system of claim 7, further comprising:

a refrigerant temperature sensor located along the fluid conduit at a refrigerant inlet of the heat exchanger and configured to measure the temperature of the refrigerant at the refrigerant inlet of the heat exchanger; and an external coolant temperature sensor located at a coolant inlet of the heat exchanger and configured to measure the temperature of the external coolant at the coolant inlet of the heat exchanger.

11. The refrigeration system of claim 7, wherein the controller is configured to:

operate the control valve to increase the flow of at least one of the refrigerant or the external coolant through the heat exchanger in response to a determination that the temperature of the external coolant is less than the temperature of the refrigerant within the fluid conduit; and operate the control valve to decrease the flow of at least one of the refrigerant or the external coolant through the heat exchanger in response to a determination that the temperature of the external coolant is greater than or equal to than the temperature of the refrigerant within the fluid conduit.

12. The refrigeration system of claim 7, further comprising an external coolant line configured to deliver the external coolant to the heat exchanger;

wherein the control valve is located along the external coolant line in parallel with the heat exchanger such that closing the control valve causes the external coolant to flow through the heat exchanger and opening the control valve causes the external coolant to bypass the heat exchanger.

13. The refrigeration system of claim 7, wherein the controller is configured to:

determine whether supplemental cooling of the refrigerant is available by comparing the temperature of the external coolant to the temperature of the refrigerant within the fluid conduit;

generate a valve setpoint for the control valve based on whether the supplemental cooling is available; and operate the control valve to achieve the valve setpoint.

14. A method for operating a refrigeration system, the method comprising:

circulating a refrigerant between an evaporator within which the refrigerant absorbs heat and a gas cooler/condenser within which the refrigerant rejects heat to provide cooling to a temperature-controlled space;

directing the refrigerant into the gas cooler/condenser or out of the gas cooler/condenser via a fluid conduit;

operating a control valve to control a flow of at least one of the refrigerant or an external coolant through a heat exchanger coupled to the fluid conduit based on a temperature of the external coolant relative to a temperature of the refrigerant within the fluid conduit;

circulating the external coolant from a building liquid source in which the refrigeration system is installed through the heat exchanger;

circulating the external coolant back to the building liquid source in which the refrigeration system is installed after flowing through the heat exchanger; and transferring heat from the refrigerant in the fluid conduit to the external coolant within the heat exchanger when the external coolant flows through the heat exchanger.

15. The method of claim 14, wherein:

the fluid conduit is coupled to an outlet of the gas cooler/condenser; and directing the refrigerant comprises directing the refrigerant from the outlet of the gas cooler/condenser through the heat exchanger.

16. The method of claim 14, wherein:

the fluid conduit is coupled to an inlet of the gas cooler/condenser; and directing the refrigerant comprises directing the refrigerant from the heat exchanger to the inlet of the gas cooler/condenser.

17. The method of claim 14, further comprising:

measuring the temperature of the refrigerant within the fluid conduit at a refrigerant inlet of the heat exchanger using a refrigerant temperature sensor located at the refrigerant inlet of the heat exchanger; and measuring the temperature of the external coolant using an external coolant temperature sensor located at a coolant inlet of the heat exchanger.

18. The method of claim 14, wherein operating the control valve comprises:

operating the control valve to increase the flow of at least one of the refrigerant or the external coolant through the heat exchanger in response to a determination that the temperature of the external coolant is less than the temperature of the refrigerant within the fluid conduit; and operating the control valve to decrease the flow of at least one of the refrigerant or the external coolant through the heat exchanger in response to a determination that the temperature of the external coolant is greater than or equal to the temperature of the refrigerant within the fluid conduit.

19. The method of claim 14, further comprising delivering the external coolant to the heat exchanger via an external coolant line;

wherein the control valve is located along the external coolant line in parallel with the heat exchanger such that closing the control valve causes the external coolant to flow through the heat exchanger and opening the control valve causes the external coolant to bypass the heat exchanger.

20. The method of claim 14, further comprising:

determining whether supplemental cooling of the refrigerant is available by comparing the temperature of the external coolant to the temperature of the refrigerant within the fluid conduit;

generating a valve setpoint for the control valve based on whether the supplemental cooling is available, the valve setpoint comprising a relative position value between a fully opened position and a fully closed position; and operating the control valve to achieve the valve setpoint.

* * * * *